US011501938B2

(12) United States Patent
Lin et al.

(10) Patent No.: US 11,501,938 B2
(45) Date of Patent: Nov. 15, 2022

(54) MAGNETIC LATCHING RELAY

(71) Applicant: Xiamen Hongfa Electroacoustic Co., Ltd., Fujian (CN)

(72) Inventors: Jinghuang Lin, Fujian (CN); Yiqing Zhu, Fujian (CN); Zhonghua Tan, Fujian (CN); Jinqiang Liu, Fujian (CN); Zhengji Lin, Fujian (CN)

(73) Assignee: Xiamen Hongfa Electroacoustic Co., Ltd., Fujian (CN)

( * ) Notice: Subject to any disclaimer, the term of this patent is extended or adjusted under 35 U.S.C. 154(b) by 62 days.

(21) Appl. No.: 16/910,605

(22) Filed: Jun. 24, 2020

(65) Prior Publication Data

US 2021/0012989 A1 Jan. 14, 2021

(30) Foreign Application Priority Data

Jul. 9, 2019 (CN) ..... 201910614479.0
Jul. 9, 2019 (CN) ..... 201910614496.4

(51) Int. Cl.
*H01H 50/36* (2006.01)
*H01H 50/04* (2006.01)
(Continued)

(52) U.S. Cl.
CPC ..... *H01H 50/043* (2013.01); *H01H 50/02* (2013.01); *H01H 50/14* (2013.01);
(Continued)

(58) Field of Classification Search
CPC ..... H01H 50/642
(Continued)

(56) References Cited

U.S. PATENT DOCUMENTS 2,924,684 A * 2/1960 Claesson ..... H01H 50/54 335/129
4,713,638 A * 12/1987 Kamo ..... H01H 51/2227 335/234

(Continued)

FOREIGN PATENT DOCUMENTS

DE 20 2004 011488 U1 9/2004

OTHER PUBLICATIONS

Extended European Search Report dated Nov. 30, 2020 in connection with European Application No. 20182368.9.
EP 20182368.9, Nov. 30, 2020, Extended European Search Report.

*Primary Examiner* — Alexander Talpalatski
(74) *Attorney, Agent, or Firm* — Wolf, Greenfield & Sacks, P.C.

(57) ABSTRACT

A magnetic latching relay includes a base, a magnetic circuit portion, a pushing card and a contact portion; the base is provided with a first blocking wall to divide the base into an upper cavity and a lower cavity, the magnetic circuit portion and the contact portion are installed in the upper cavity and the lower cavity respectively; an iron core, two yokes and a magnetic steel of the magnetic circuit portion are formed an E-shaped magnetic conductive structure with a 90 degrees side turn; the middle position of an armature is rotatably supported above the magnetic steel, two ends of the armature respectively correspond to the tops of the two yokes; an
(Continued)

upper end of the pushing card is connected to one end of the armature, and a lower end of the pushing card is connected to a free end of a movable spring of the contact portion.

19 Claims, 19 Drawing Sheets

(51) Int. Cl.
*H01H 50/02* (2006.01)
*H01H 50/14* (2006.01)
*H01H 50/18* (2006.01)
*H01H 50/44* (2006.01)
*H01H 50/64* (2006.01)

(52) U.S. Cl.
CPC ..... *H01H 50/18* (2013.01); *H01H 50/36* (2013.01); *H01H 50/44* (2013.01); *H01H 50/642* (2013.01); *H01H 50/643* (2013.01)

(58) Field of Classification Search
USPC ..... 335/129, 128, 79
See application file for complete search history.

(56) References Cited

U.S. PATENT DOCUMENTS 5,144,270 A * 9/1992 Schedele ..... H01H 50/642 335/128
5,548,259 A * 8/1996 Ide ..... H01H 50/026 335/128
5,805,039 A * 9/1998 Smith ..... H01H 51/2281 335/78
5,844,456 A 12/1998 Mader
5,880,653 A * 3/1999 Yamada ..... H01H 50/041 335/78
6,043,730 A * 3/2000 Maenishi ..... H01H 51/2272 335/229
6,608,539 B2 * 8/2003 Nobutoki ..... H01H 51/2272 335/78
7,307,499 B2 * 12/2007 Nakamura ..... H01H 51/2272 335/128
8,461,951 B2 * 6/2013 Gassmann ..... H01F 7/122 335/276
9,275,815 B2 * 3/2016 Hoffmann ..... H01H 50/18
2013/0229246 A1 9/2013 Fujita et al.
2015/0042423 A1 2/2015 Hoffmann et al.

* cited by examiner

MAGNETIC LATCHING RELAY

RELATED APPLICATIONS

Foreign priority benefits are claimed under 35 U.S.C. § 119(A)-(D) OR 35 U.S.C. § 365(b) of Chinese Patent Application No. 201910614496.4, filed Jul. 9, 2019 and Chinese Application number, 201910614479.0 filed on Jul. 9, 2019, the entire contents thereof are incorporated herein by reference.

TECHNICAL FIELD

The present disclosure relates to the technical field of relay, and in particular, to a miniaturized high-power magnetic latching relay.

BACKGROUND

The relay is an electronic control device, which has a control system (also called input loop) and a controlled system (also called output loop), and is usually applied in automatic control circuits. The relay is actually an "automatic switch" that uses a smaller current to control a larger current. Therefore, it plays the role of automatic adjustment, safety protection and conversion circuit in the circuit. However, the magnetic latching relays of the related art are usually large in size and cannot achieve the characteristics of miniaturization and high power.

SUMMARY

According to one aspect of the present disclosure, a magnetic latching relay is provided, including: a base, a magnetic circuit portion, a pushing card, a contact portion; the base is provided with a first blocking wall to divide the base into an upper cavity and a lower cavity, the magnetic circuit portion is installed in the upper cavity and the contact portion is installed in the lower cavity; the magnetic circuit portion comprising an iron core, two yokes, a magnetic steel which is a permanent magnet, and an armature; the iron core is strip-shaped and arranged horizontally, and the two yokes are plate-shaped, wherein the two yokes are respectively fixed on both ends of the iron core, and the magnetic steel is matched in the middle of the iron core, so that the iron core, the two yokes and the magnetic steel are formed an E-shaped magnetic conductive structure with a 90 degrees side turn; the middle position of the armature is rotatably supported above the position corresponding to the magnetic steel, and two ends of the armature respectively correspond to the tops of the two yokes, so as to perform the seesaw type action in cooperation with the magnetic conductive structure; an upper end of the pushing card is connected to one end of the armature, and a lower end of the pushing card is connected to a free end of a movable spring of the contact portion.

According to some embodiment of the present disclosure, the iron core is a flat strip-shaped structure, a square through hole is provided at the center of each of the two yokes, the two yokes are riveted and fixed to the two ends of the iron core along the longitudinal direction through the square through hole; two positioning protrusions are provided on both sides of each of the two yokes, the positioning protrusions are configured as a positioning structure of the magnetic circuit portion cooperating with the base; the top of each of the two yokes is arranged as a working pole surface matched with both ends of the armature.

According to some embodiment of the present disclosure, the iron core is arranged to extend along the length direction of the base, in the longitudinal direction of the base, an receiving groove of which an opening is configured to face the front and outside is provided on a front end of the base and the receiving groove is used to accommodate the pushing card, one end of the armature is configured to extend from above of the upper cavity to above of the receiving groove and connect to the upper end of the pushing card accommodated in the receiving groove; the bottom of the receiving groove is configured to communicate with the lower cavity so that the lower end of the pushing card accommodated in the receiving groove is connected to a free end of the movable spring of the contact portion in the lower cavity.

According to some embodiment of the present disclosure, the upper cavity is a frame structure with a concave shape, and a front portion of the upper cavity is arranged as a support platform for supporting the front of the magnetic circuit portion, a rear portion of the upper cavity is arranged as a sink slot for matching the coil structure of the magnetic circuit portion, and a ramp-shaped web is formed between the front portion and the rear portion.

According to some embodiment of the present disclosure, both sides of a front end and a rear end of the upper cavity are respectively provided with notches for assembling the magnetic circuit portion to achieve positioning; dispensing gates are respectively provided on both sides of the receiving groove to fix the magnetic circuit portion when the magnetic circuit portion is inserted into the upper cavity and the clamping force is insufficient.

According to some embodiment of the present disclosure, the lower cavity is provided with openings communicating with the outside along a width direction of the base, the movable spring and a stationary spring in the contact portion are respectively inserted into the lower cavity from two openings along the width direction of the base and are fixed by being inserted and connected through horizontal slots provided in the lower cavity.

According to some embodiment of the present disclosure, there are two second blocking walls at positions corresponding to the matching of the movable spring and the stationary spring to realize an isolation between the movable spring and the stationary spring by using the two second blocking walls and an air gap between the two blocking walls, so that effectively increase the insulation distance between the movable spring and the stationary spring.

According to some embodiment of the present disclosure, the coil structure comprises a bobbin; the bobbin comprises flanges at both ends along the length direction, a winding window portion between the flanges at both ends, and an iron core mounting hole penetrating through the flanges at both ends along the length direction; wherein the winding window portion is rod-shaped and hollow; a retaining wall is also provided in the middle of the winding window portion of the bobbin to divide the winding window portion of the bobbin into isolated first winding window portion and a second winding window portion; a top surface of the retaining wall is provided with a recess recessed downward, and the recess is configured to communicate with the iron core mounting hole; the iron core is installed inside the winding window portion, and both ends of the iron core are installed in the iron core mounting hole, the two yokes are respectively fitted at outside of the flanges at both ends of the bobbin, and the magnetic steel is installed in the recess; limiting lug bosses are provided on both sides of the recess to restrict a movement of the magnetic steel inserted into the recess along a width direction of the bobbin.

According to some embodiment of the present disclosure, a shaft component is also installed in the middle of the armature so that both ends of the armature have a seesaw structure; shafts are provided on both sides of the shaft component respectively, the top of each of the limiting lug bosses is provided with a semi-circular notch for installing the shaft of the armature to match the shaft of the shaft component of the armature to restrict the movement of the shaft of the armature along a length direction of the bobbin.

According to some embodiment of the present disclosure, giving way notches are provided on both sides distributed along the width direction of the armature, the giving way notches are configured to extend from a position of the armature near one end to a position of the armature near the middle, so as to facilitate installation of the shaft component, the shaft component is inserted into the armature through the giving way notches and is moved to the middle to form an interference fit with the armature, two limiting protrusions are provided on both sides of the middle portion of the armature near the other end of the armature in the width direction to limit the movement of the shaft component in a direction of toward one end of the armature.

According to some embodiment of the present disclosure, the coil structure further comprises an enameled wire and a coil terminal; the coil terminal comprises a start terminal, a common terminal and an end terminal, the three terminals are installed side by side along the width direction of the bobbin in the flange on a side close to the first winding window portion, and the three terminals have the same orientation; a wire groove for connecting the first winding window portion and the second winding window portion is provided on the retaining wall, and a bridge terminal is installed in the retaining wall, and orientation of the bridge terminal is the same as the orientation of the three terminals; the enameled wire is configured to start from the start terminal and connect to the bridge terminal after being wound by a single-coil method or a double-coil method, and is connected to the end terminal across the first winding window portion through the bridge terminal, so that a wound start wire and an end wire are spatially separated.

According to some embodiment of the present disclosure, three terminal holes for inserting the three terminals are provided in the flange on a side close to the first winding window portion, the three terminal holes are arranged at regular intervals along the width direction of the bobbin, the common terminal is inserted into a terminal hole which is located in a middle position among the three terminal holes.

According to some embodiment of the present disclosure, the single-coil method is that drawing out the enameled wire from the start terminal, and then winding a first coil on the first winding window portion, after winding the first coil, dragging the enameled wire to the second winding window portion through the wire groove to wind a second coil, after winding a second coil, the enameled wire is connected to the bridge terminal, and then is connected to the end terminal across the first winding window portion through the bridge terminal, so that the wound start wire and the end wire are spatially separated.

According to some embodiment of the present disclosure, the double-coil method is that drawing out the enameled wire from the start terminal, and then winding a first coil on the first winding window portion, after winding the first coil, connecting the enameled wire to the common terminal, and then starting from the common terminal, winding a few turns at a step with a large pitch on the first winding window portion, and then dragging the enameled wire to the second winding window portion through the wire groove to wind a second coil, after winding the second coil, the enameled wire is connected to the bridge terminal, and then is connected to the end terminal across the first winding window portion through the bridge terminal, so that the start wire of the first coil of the double coil structure and the end wire of the second coil of the double coil structure are spatially separated.

According to some embodiment of the present disclosure, a cross-sectional shape of the winding window portion is substantially rectangular, and the retaining wall is substantially rectangular shape, the wire groove and the bridge terminal are respectively provided on a bottom surface of the retaining wall, a first slot is provided at a connection position corresponding to the bridge terminal, the bridge terminal is inserted into the first slot of the retaining wall, and both of the bridge terminal and the first slot are in an interference fit.

According to some embodiment of the present disclosure, the wire groove is diagonally connected between the first winding window portion and the second winding window portion.

According to some embodiment of the present disclosure, in groove walls on both sides of the wire groove, positions connected to the first winding window portion and the second winding window portion are respectively set in an arc-shaped structure.

According to some embodiment of the present disclosure, the pushing card is provided with two connecting arms with a certain distance therebetween and a certain length, the two connecting arms are formed by an upper portion of the pushing card protruding upwards, so that the two connecting arms can be flexibly expanded to make two sides of the armature in the width direction be snapped between the two connecting arms, and realizing that when the armature swings up and down, the pushing card is driven to move up and down.

According to some embodiment of the present disclosure, a lower portion of the pushing card is provided with a substantially rectangular through hole, and an end of the movable spring provided with a movable contact is movably hooked in the through hole of the lower portion of the pushing card, when the pushing card moves up and down, the end of the movable spring with the movable contact swings up and down; an upper hole wall and a lower hole wall of the through hole of the pushing card are respectively arranged in a shape of a circular arc surface, so that when the pushing card moves, the pushing card and the movable spring come into line-to-surface contact, a distance between the upper hole wall and the lower hole wall of the through hole is greater than a thickness of the end of the movable spring where the movable contact is provided.

BRIEF DESCRIPTION OF THE DRAWINGS

The disclosure will be described in further detail below with reference to the drawings and embodiments; however, a miniaturized high-power magnetic latching relay of the disclosure is not limited to the embodiments.

DETAILED DESCRIPTION

Figure 1:
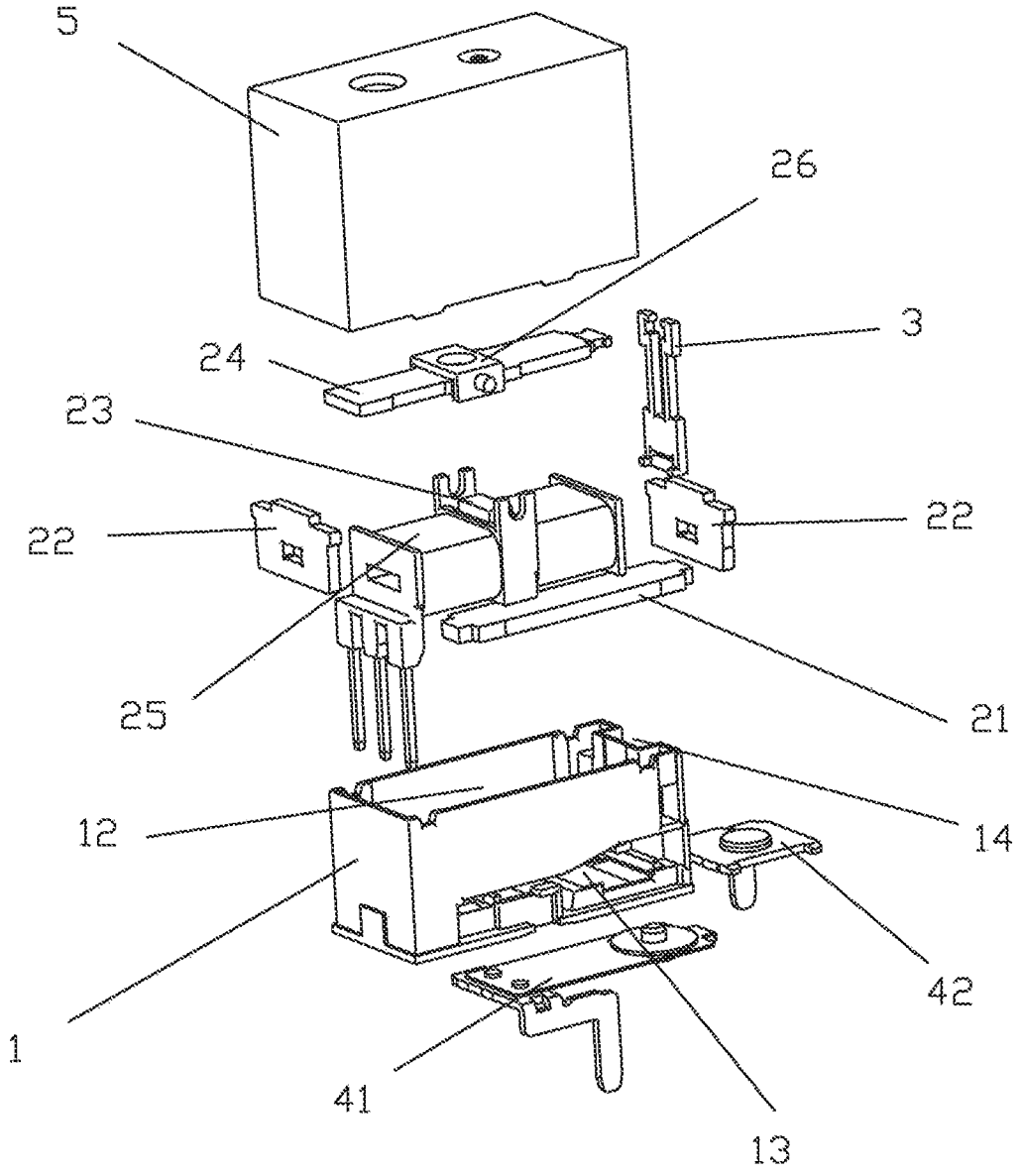
FIG. 1 is an exploded perspective schematic view of the structure of a magnetic latching relay of some embodiments of the present disclosure.

The magnetic latching relay is one of the relays and an automatic switch. Like other electromagnetic relays, it plays a role in automatically closing and opening the circuit, the difference is that the normally closed or normally open state of the magnetic latching relay is completely dependent on the permanent magnetic steel, and the switching between the close or open state is completed by the triggering of a pulse electrical signal with a certain width. The magnetic latching relay usually includes a magnetic circuit portion, a contact portion, a pushing card and a base; the magnetic circuit portion and the contact portion are respectively installed on the base, and the pushing card is connected between the magnetic circuit portion and the contact portion. When a positive pulse is applied to the coil (or the set coil is energized), the magnetic circuit portion works, the pushing card pushes the movable spring of the contact portion, so that the movable contact contacts the stationary contact of the contact portion, and the then the relay operates. When a reverse pulse voltage is applied to the coil (or the reset coil is energized), the magnetic circuit portion works, the pushing card pushes the movable spring of the contact portion, so that the movable contact is opened from the stationary contact of the contact portion, and the relay is reset. The armature component in the magnetic circuit portion of the magnetic latching relay is usually designed in a shape of H and has a seesaw structure. The magnetic steel is installed in the armature component, the yoke is in a shape of L, the vertical sides of the L-shape of the two yokes are fixed to the two ends of the iron core, and the horizontal sides of the L-shape of the two yokes are respectively match with the two openings of the H-shape of the armature component.

As shown in FIGS. 1 to 26, a miniaturized high-power magnetic latching relay of the present disclosure includes a base 1, a magnetic circuit portion 2, a pushing card 3, a contact portion 4 and a housing 5. The base 1 is provided with a first blocking wall 11 to divide the base 1 into an upper cavity 12 and a lower cavity 13, the magnetic circuit portion 2 is installed in the upper cavity 12 and the contact portion 4 is installed in the lower cavity 13 to achieve strong and weak electrical isolation; the magnetic circuit portion 2 includes an iron core 21, two yokes 22, a magnetic steel 23 which is a permanent magnet, and an armature 24; the iron core 21 is strip-shaped and arranged horizontally, and the yoke 22 is plate-shaped. The two yokes 22 are respectively fixed on both ends of the iron core 21, and the magnetic steel 23 is matched in the middle of the iron core 21, after the assembly of the iron core 21, the yoke 22 and the magnetic steel 23 is completed, the iron core 21, the yoke 22 and the magnetic steel 23 can form an E-shaped magnetic conductive structure, that is, the shape of the magnetic conductive structure shown in FIG. 1 after being turned 90 degrees sideways. The middle position of the armature 24 is rotatably supported above the position corresponding to the magnetic steel 23, and the two ends of the armature 24 respectively correspond to the tops of the two yokes 22, so as to perform the seesaw type action in cooperation with the magnetic conductive structure; the upper end of the pushing card 3 is connected to one end of the armature 24, and the lower end of the pushing card 3 is connected to the free end of the movable spring 41 of the contact portion.

Figure 20:
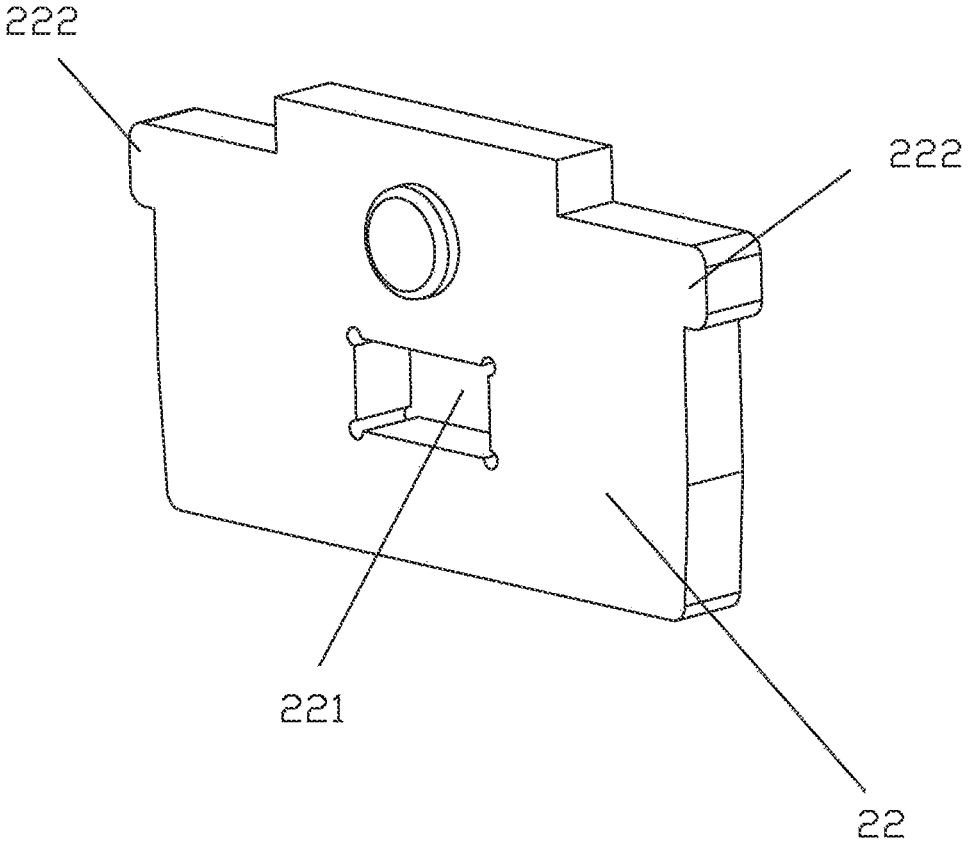
FIG. 20 is a perspective schematic view of the structure of a yoke of some embodiments of the present disclosure.

In some embodiments, as shown in FIG. 1, the iron core 21 is a flat strip-shaped structure. As shown in FIG. 20, a square through hole 221 is provided at the center of the each of the two yokes 22, the two yokes 22 are riveted and fixed to the two ends of the iron core 21 along the longitudinal direction L through the square through holes 221; two positioning protrusions 222 are provided on both sides of the yoke 22, the positioning protrusions 222 protrude outward from the top portion of the two sides of the yoke 22, and the positioning protrusions 222 as the positioning structure of the magnetic circuit portion 2 cooperate with the base 1. The top of the yoke 22 is arranged as a working pole surface matched with both ends of the armature 24.

Figure 2:
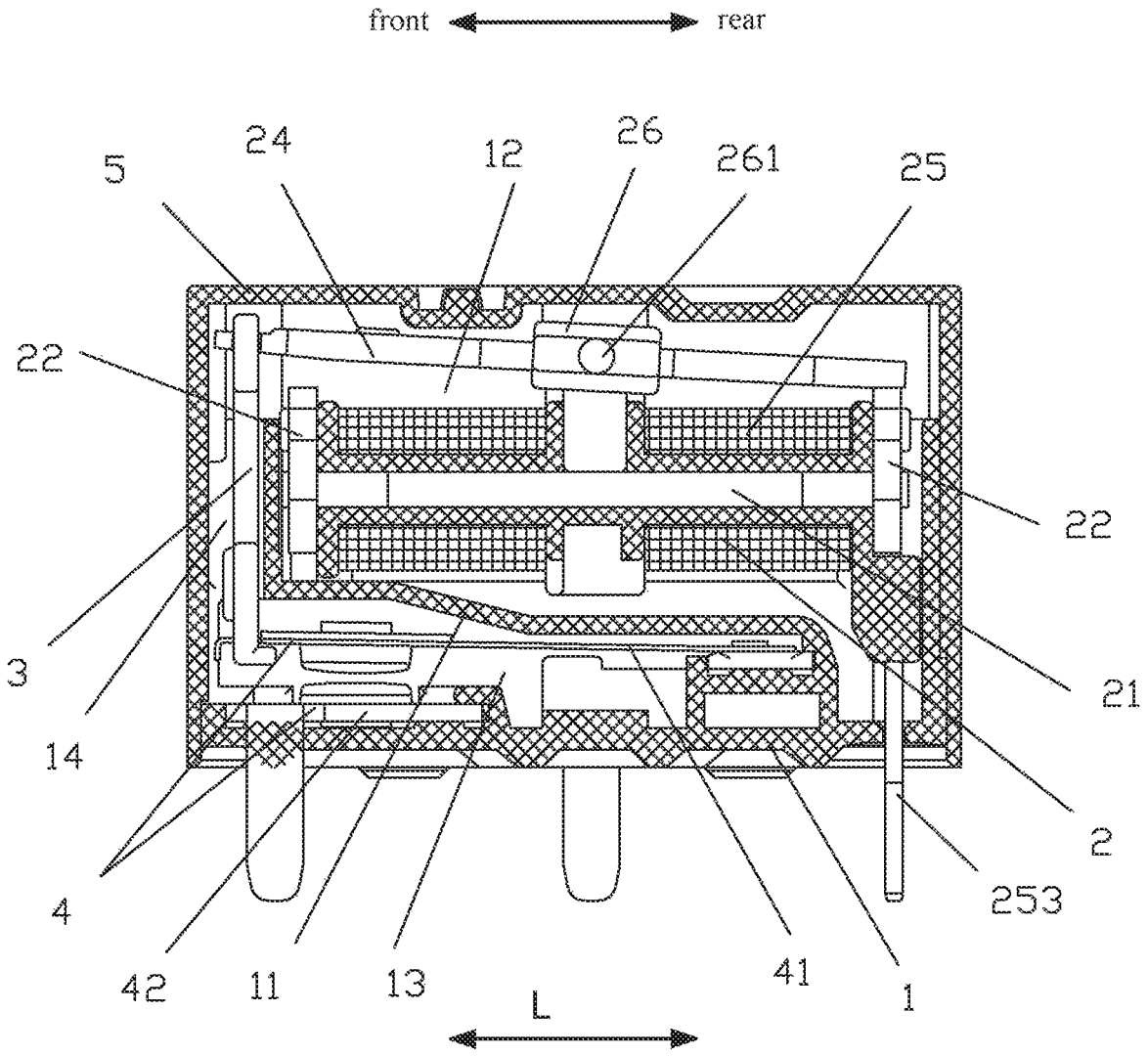
FIG. 2 is a cross-sectional view of a magnetic latching relay of some embodiments of the present disclosure.

In some embodiments, as shown in FIG. 1, the iron core 21 is arranged to extend along the length direction L of the base 1, in the longitudinal direction L of the base 1, the front end of the base 1 is provided with a receiving groove 14 that is open toward the front and outside and is used to accommodate the pushing card 3. As shown in FIG. 2, one end of the armature 24 extends from the above of the upper cavity 12 to the above of the receiving groove 14 and is connected to the upper end of the pushing card 3 accommodated in the receiving groove 14. The bottom of the receiving groove 14 communicates with the lower cavity 13 so that the lower end of the pushing card 3 accommodated in the receiving groove 14 is connected to the free end of the movable spring 41 of the contact portion 4 of the lower cavity 13.

It should be noted that the "front" and "rear" in the present disclosure refer to the two sides along the length direction of the base 1 or the bobbin 251, as indicated by the arrow in FIG. 2. Of course, the "front" and "rear" are only defined for the convenience of describing the structure of the magnetic latching relay, and are not limited. If the "front" is described as "rear", the original "rear" becomes the "front".

Figure 3:
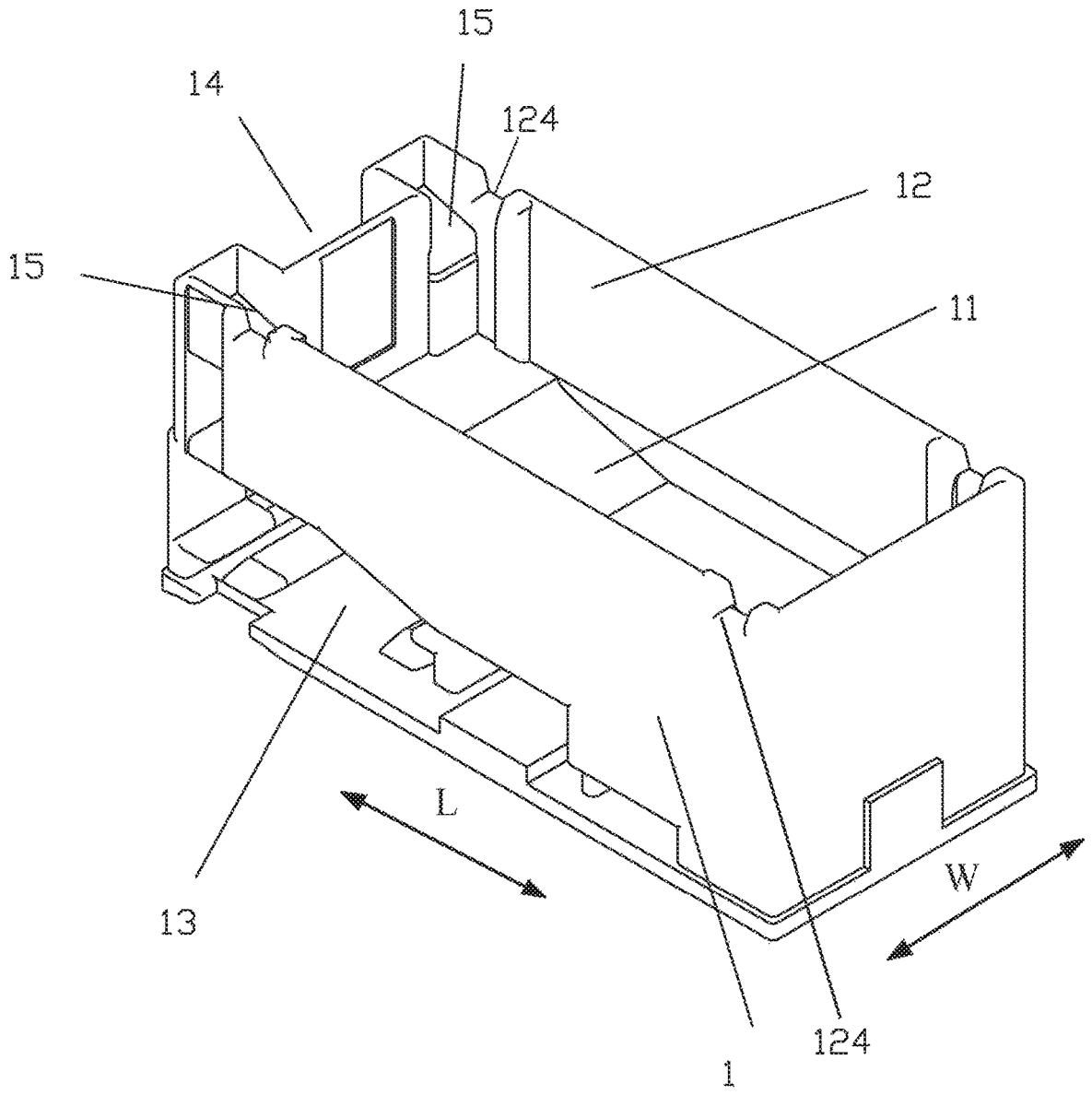
FIG. 3 is an exploded perspective schematic view of the structure of a base of some embodiments of the present disclosure.
Figure 4:
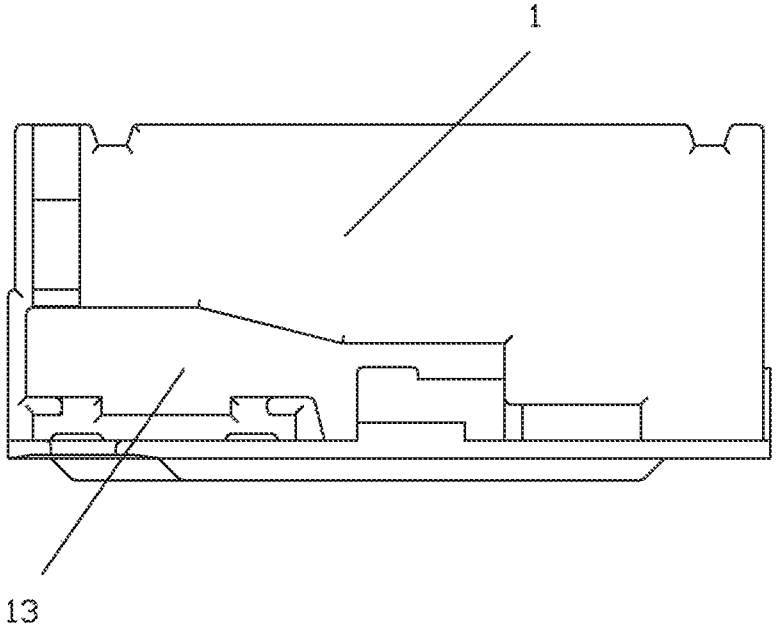
FIG. 4 is a front view of the base of some embodiments of the present disclosure.
Figure 7:
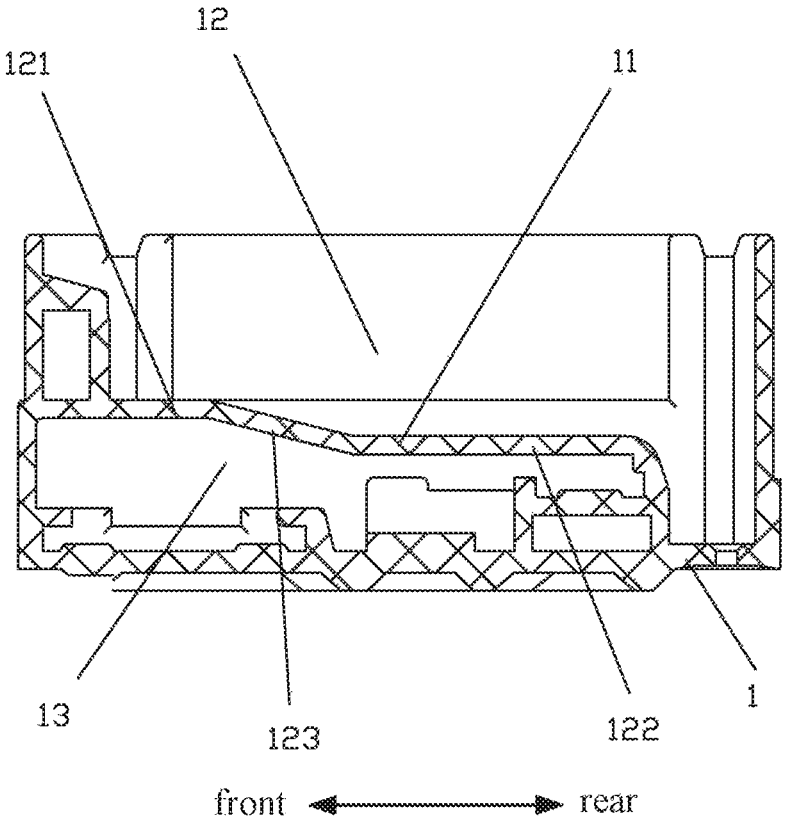
FIG. 7 is a cross-sectional view of a base of some embodiments of the present disclosure.

In some embodiments, as shown in FIGS. 1, 3 and 7, the upper cavity 12 is a frame structure with a concave shape, and the front portion of the upper cavity 12 is arranged as a support platform 121 for supporting the front of the magnetic circuit portion 2, the rear portion 122 of the upper cavity 12 is arranged as a sink slot for matching the coil structure 25 of the magnetic circuit portion, and a ramp-shaped web 123 is formed between the front portion and the rear portion.

Figure 5:
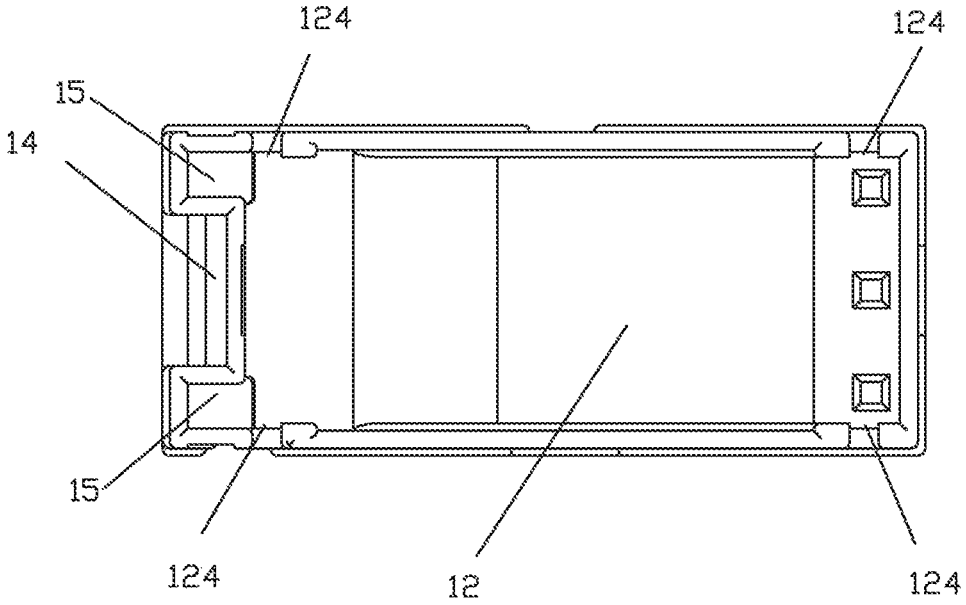
FIG. 5 is a top view of the base of some embodiments of the present disclosure.

In some embodiments, as shown in FIGS. 3 and 5, both sides of the front and rear ends of the upper cavity 12 are respectively provided with notches 124 for assembling the magnetic circuit portion 2 to achieve positioning. The positioning protrusions 222 on both sides of the two yokes 22 of the magnetic circuit portion 2 are respectively fitted in the notches 124 on both sides of the front and rear ends of the upper cavity 12. Dispensing gates 15 are respectively provided on both sides of the receiving groove 14 to fix the magnetic circuit portion 2 when the magnetic circuit portion 2 is inserted into the upper cavity 12 and the clamping force is insufficient.

In some embodiments, the lower cavity 13 is provided with openings communicating with the outside along the width direction W of the base 1, the movable spring 41 and the stationary spring 42 in the contact portion 4 are respectively inserted into the lower cavity 13 from two openings along the width direction W of the base 1, and are fixed by being inserted and connected through the horizontal slots provided in the lower cavity 13.

Figure 6:
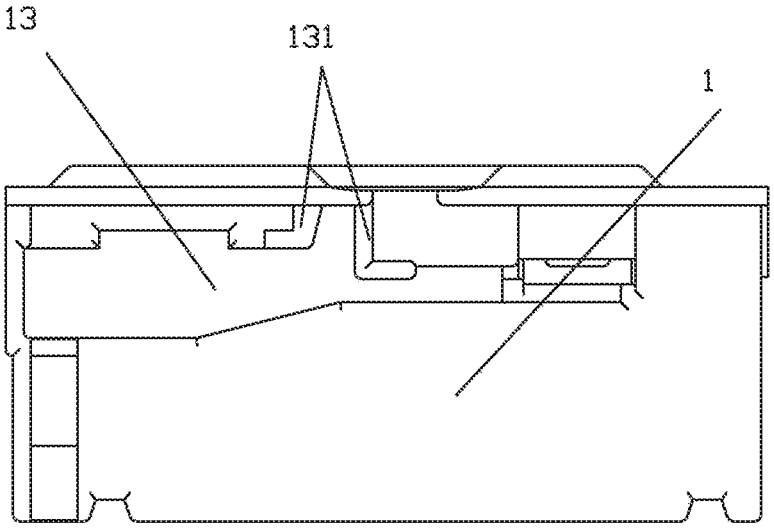
FIG. 6 is a rear view of the base of some embodiments of the present disclosure.

As shown in FIG. 6, in the lower cavity 13, there are two second blocking walls 131 at positions corresponding to the matching of the movable spring 41 and the stationary spring 42 to realize the isolation between the movable spring 41 and the stationary spring 42 by using the two second blocking walls 131 and the air gap between the two second blocking walls 131, so as to effectively increase the insulation distance between the movable spring and stationary spring.

Figure 8:
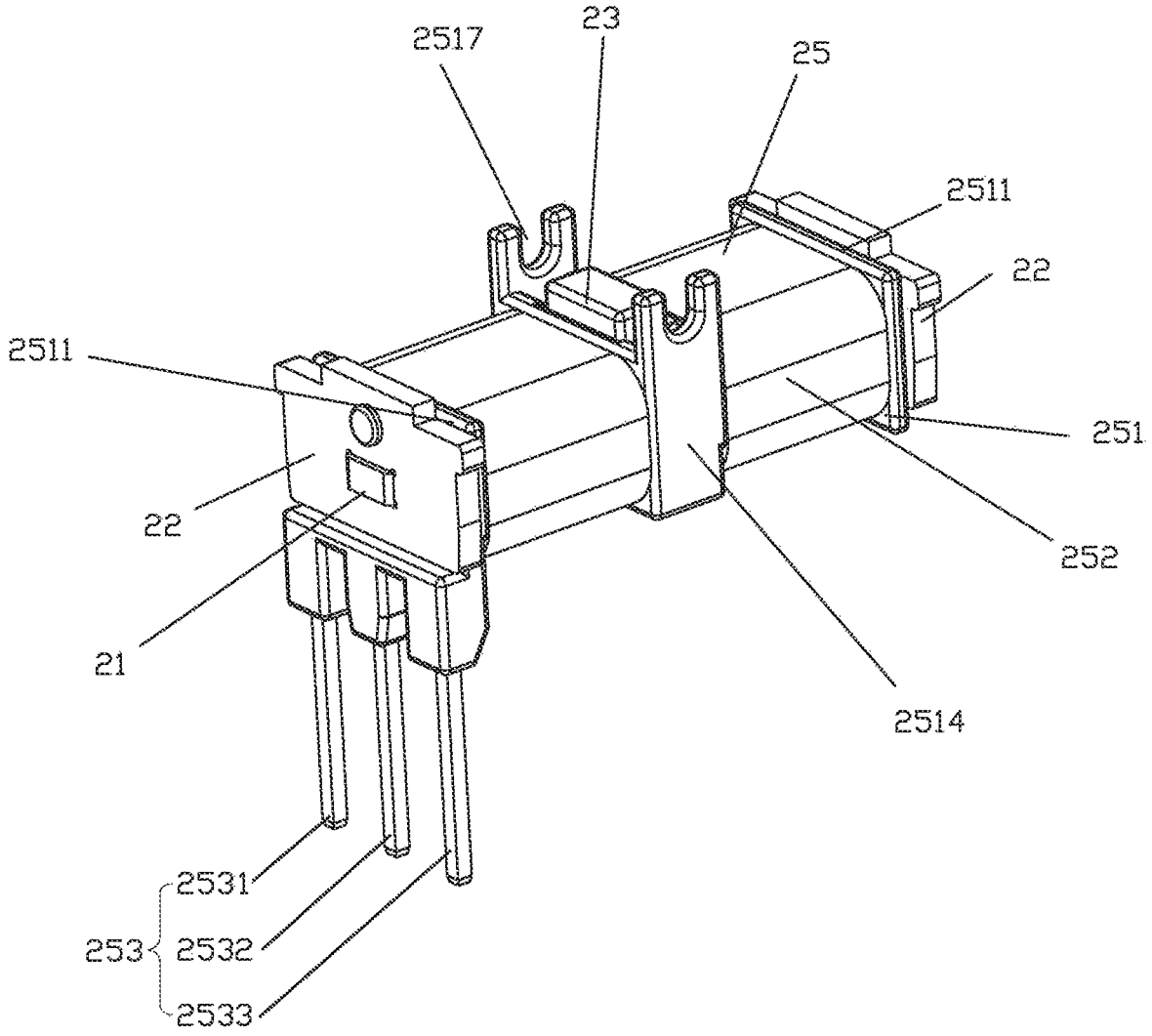
FIG. 8 is a schematic view of a partial structure of a magnetic circuit portion of some embodiments of the present disclosure.
Figure 9:
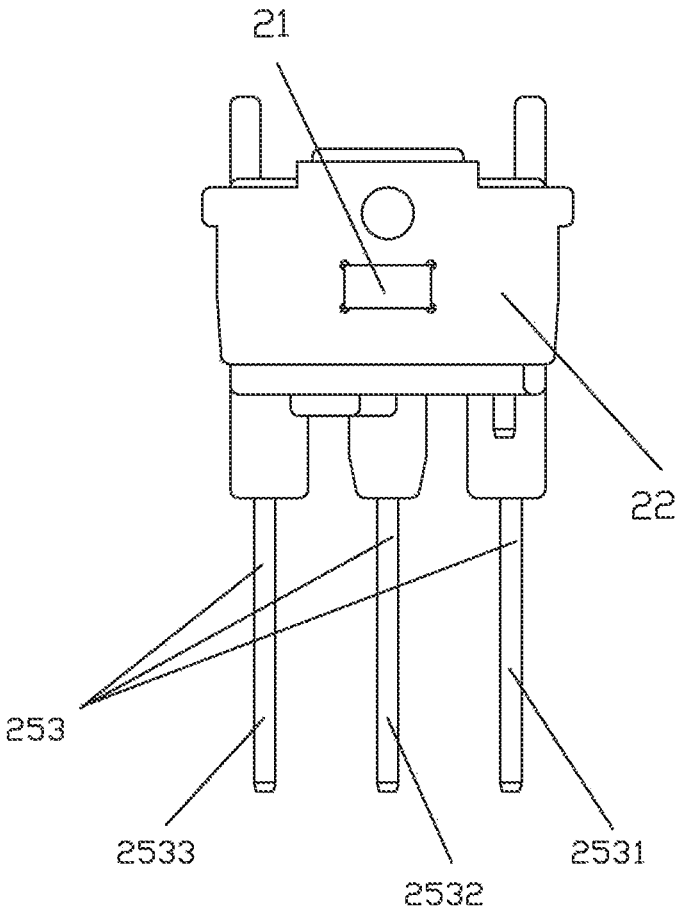
FIG. 9 is a side view of a coil structure of some embodiments of the present disclosure.
Figure 10:
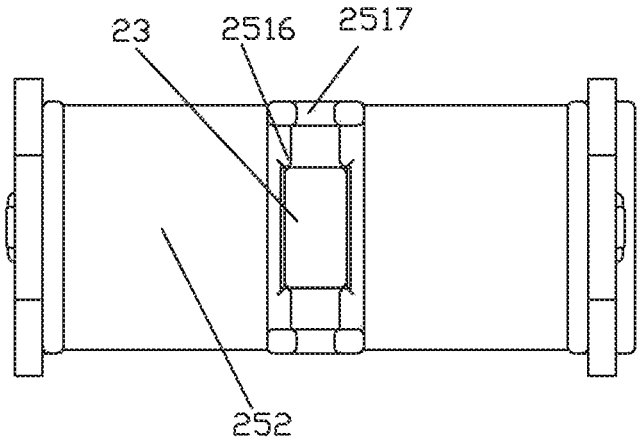
FIG. 10 is a schematic view of the coil structure of some embodiments of the present disclosure installed with a magnetic steel.
Figure 12:
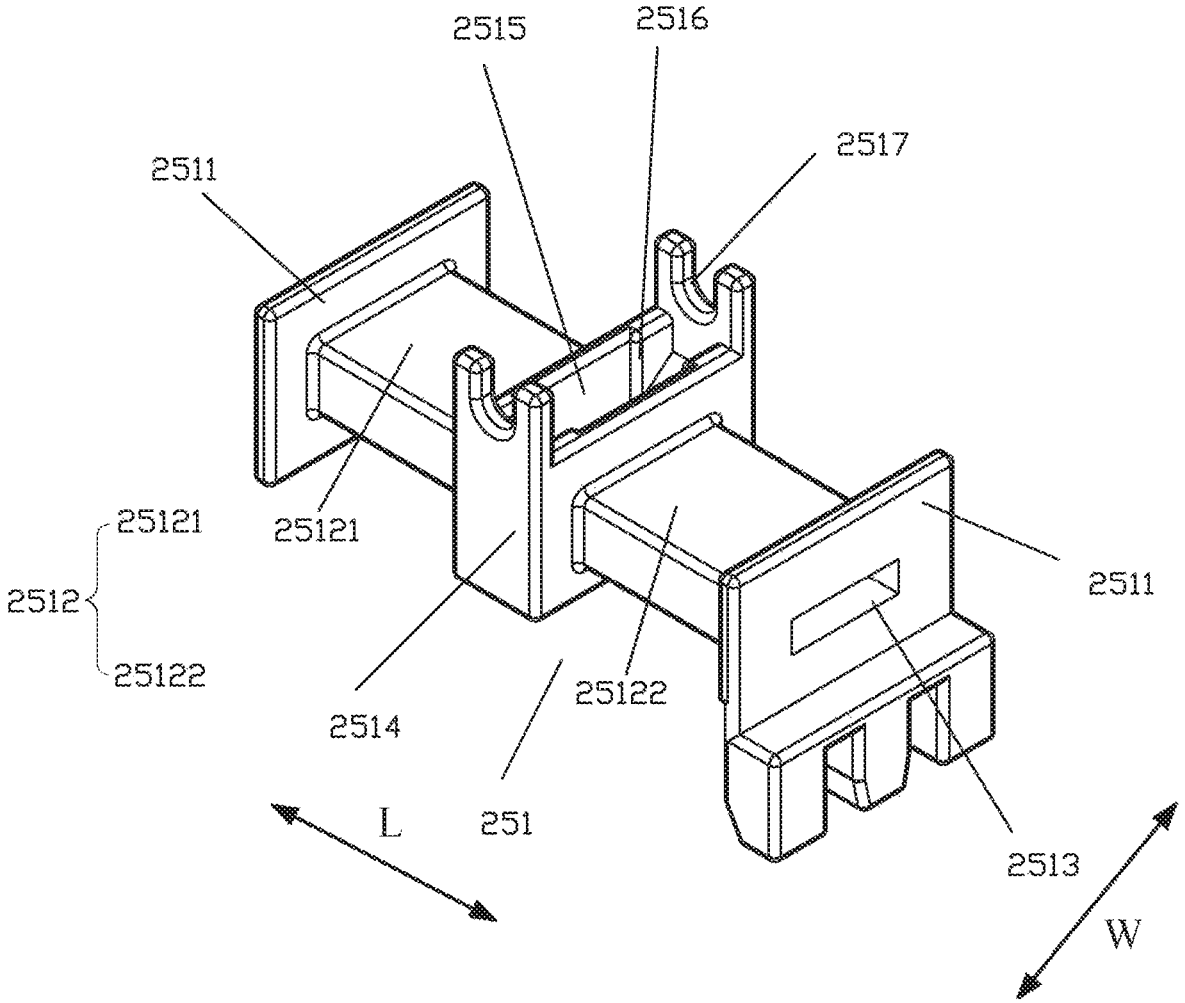
FIG. 12 is a perspective schematic view of the structure of a bobbin of some embodiments of the present disclosure.

In some embodiments, as shown in FIGS. 8-9 and 12, the coil structure 25 includes a bobbin 251; The bobbin 251 includes flanges 2511 at both ends of the bobbin 251 along the length direction L (the length direction of the bobbin 251 is the same as the longitudinal direction of the base 1), a winding window portion 2512 between the flanges 2511 at both ends and an iron core mounting hole 2513 penetrating through the flanges 2511 at both ends of the bobbin 251 along the length direction L; the winding window portion 2512 is rod-shaped and hollow, a retaining wall 2514 is also provided in the middle of the winding window portion 2512 of the bobbin 251 to divide the winding window portion 2512 of the bobbin 251 into isolated first winding window portion 25121 and a second winding window portion 25122. The top surface of the retaining wall 2514 is provided with a recess 2515 recessed downward, and the recess 2515 communicates with the iron core mounting hole 2513; the iron core 21 is installed inside the winding window portion 2512, and both ends of the iron core 21 are installed in the iron core mounting hole 2513, as shown in FIG. 8, two yokes 22 are respectively fitted at the outside of the flanges 2511 at both ends of the bobbin 251, and the magnetic steel 23 is installed in the recess 2515. As shown in FIG. 12, limiting lug bosses 2516 are provided on both sides of the recess 2515 to restrict the movement of the magnetic steel 23 inserted into the recess 2515 along the width direction W of the bobbin 251 (the width direction of the bobbin 251 is the same as the width direction of the base).

Figure 14:
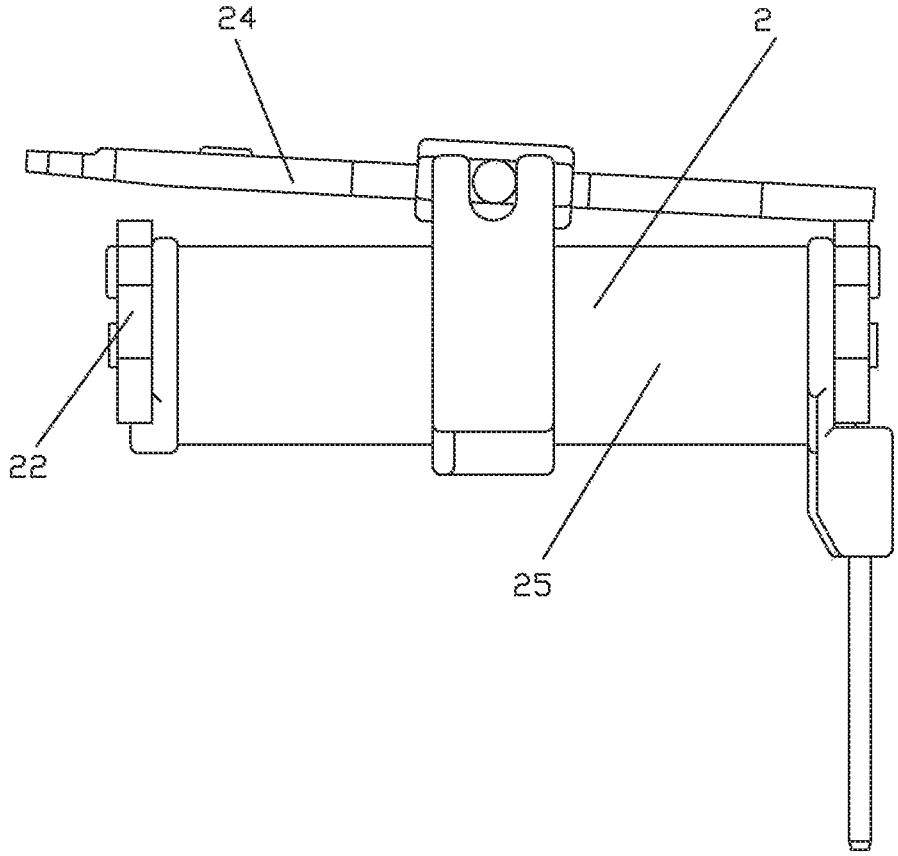
FIG. 14 is a front view of a magnetic circuit portion of some embodiments of the present disclosure.
Figure 15:
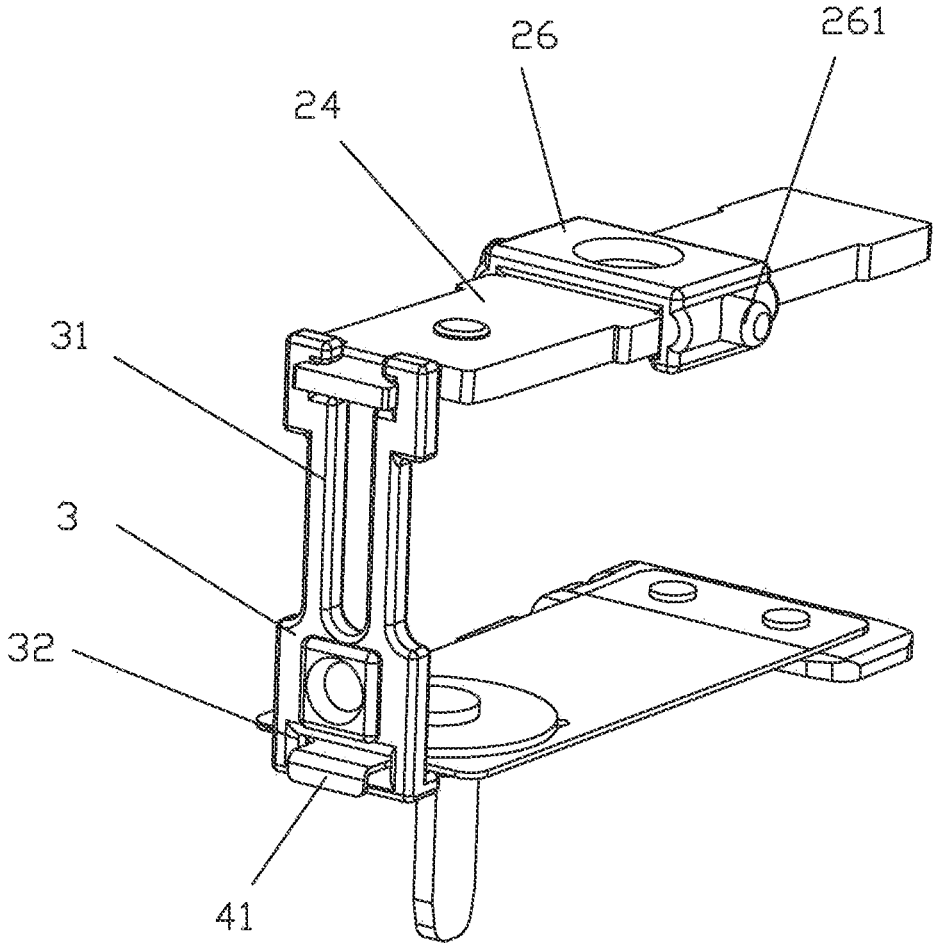
FIG. 15 is a schematic view of the cooperation of the pushing card, the movable spring and the armature of some embodiments of the present disclosure.

In some embodiments, as shown in FIGS. 14 to 15, a shaft component 26 is also installed in the middle of the armature 24 so that both ends of the armature 24 have a seesaw structure. Shafts 261 are provided on both sides of the shaft component 26 respectively, as shown in FIG. 12, the top of the limiting lug boss 2516 is provided with a semi-circular notch 2517 for installing the shaft 261 of the armature 24 to match the shaft 261 of the shaft component 26 of the armature 24 to restrict the movement of the shaft 261 of the armature 24 along the length direction L of the bobbin 251.

Figure 18:
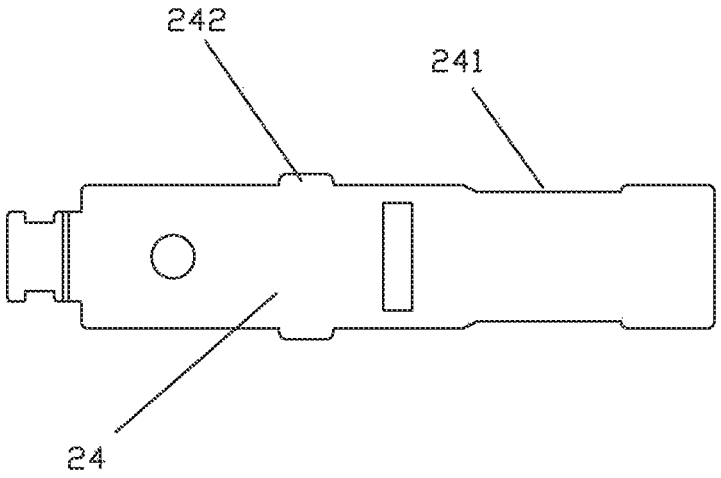
FIG. 18 is a schematic diagram of the structure of an armature of some embodiments of the present disclosure.
Figure 19:
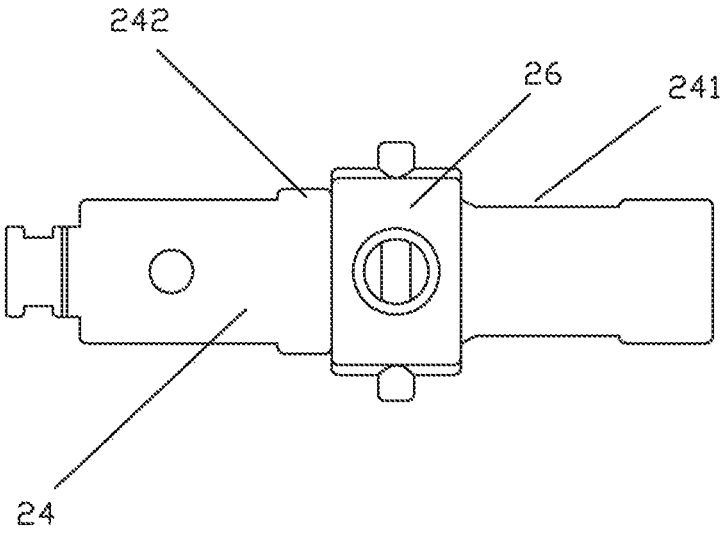
FIG. 19 is a schematic view of the cooperation of the armature and the shaft component of some embodiments of the present disclosure.

In some embodiments, as shown in FIGS. 18 to 19, a plurality of giving way notches 241 are provided on both sides distributed along the width direction of the armature 24, specifically, the giving way notches 241 extend from a position of the armature 24 near one end to a position of the armature 24 near the middle, to facilitate installation of the shaft component 26, the shaft component 26 is inserted into the armature 24 through the giving way notches 241, and is moved to the middle to form an interference fit with the armature 24, two limiting protrusions 242 are provided on both sides of the middle portion of the armature 24 near the other end of the armature 24 in the width direction to limit the movement of the shaft component 26 in the direction of toward one end of the armature 24.

Figure 13:
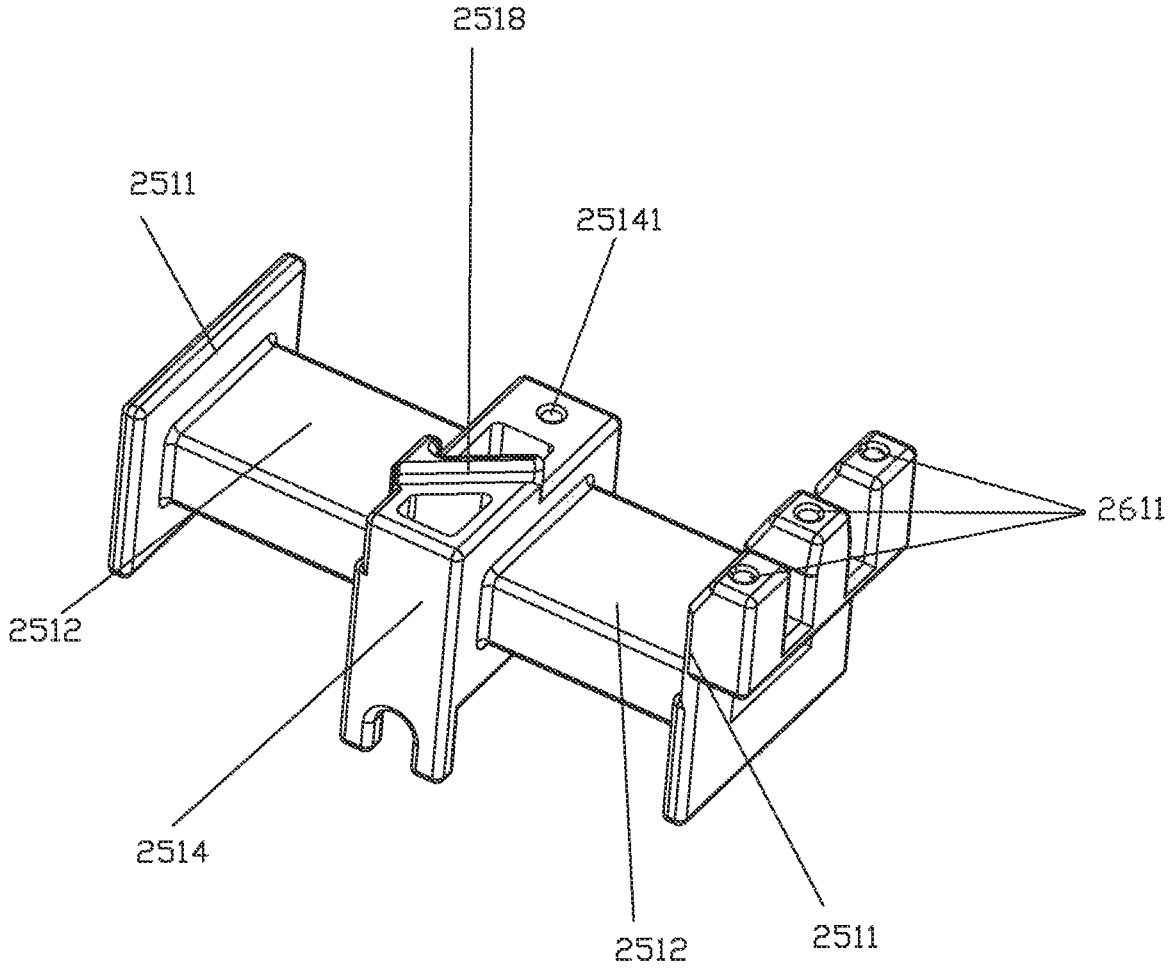
FIG. 13 is a perspective schematic view of the structure of a bobbin of some embodiments of the present disclosure (in an upside down state of the bobbin of the FIG. 12).
Figure 26:
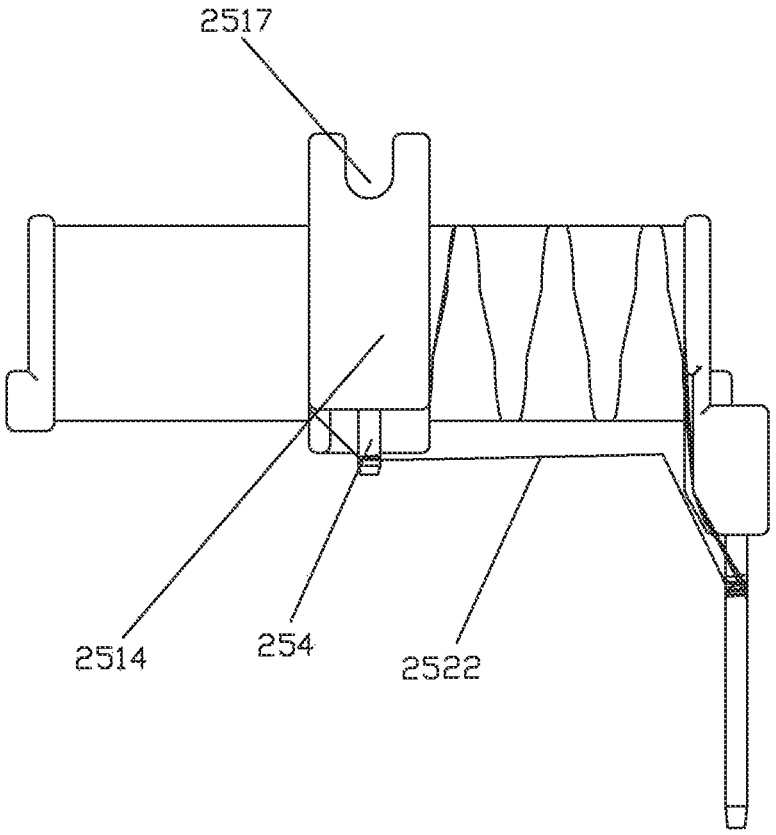
FIG. 26 is a schematic view of a process in which the coil structure of some embodiments of the present disclosure is wound by a double-coil method (the first process).

In some embodiments, as shown in FIG. 8, the coil structure 25 further includes an enameled wire 252 and a coil terminal 253; the coil terminal 253 includes a start terminal 2531, a common terminal 2532, and an end terminal 2533, the three terminals are installed side by side along the width direction W of the bobbin 251 in the flange 2511 on the side close to the first winding window portion 25121, and the three coil terminals 253 have the same orientation. As shown in FIG. 13, a wire groove 2518 for connecting the first winding window portion 25121 and the second winding window portion 25122 is provided on the retaining wall 2514, and a bridge terminal 254 (as shown in FIG. 26) is installed in the retaining wall 2514, the wire groove 2518 and the bridge terminal 254 are located between the first winding window portion 25121 and the second winding window portion 25122, and the orientation of the bridge terminal 254 is the same as the orientation of the three coil terminals 253. The enameled wire 252 starts from the start terminal 2531 and is wound by a single-coil method or a double-coil method, and then is connected to a bridge terminal 254, and is connected to the end terminal 2533 across the first winding window portion 25121 through the bridge terminal 254, so that the wound start wire 2521 and the end wire 2522 are spatially separated.

Figure 21:
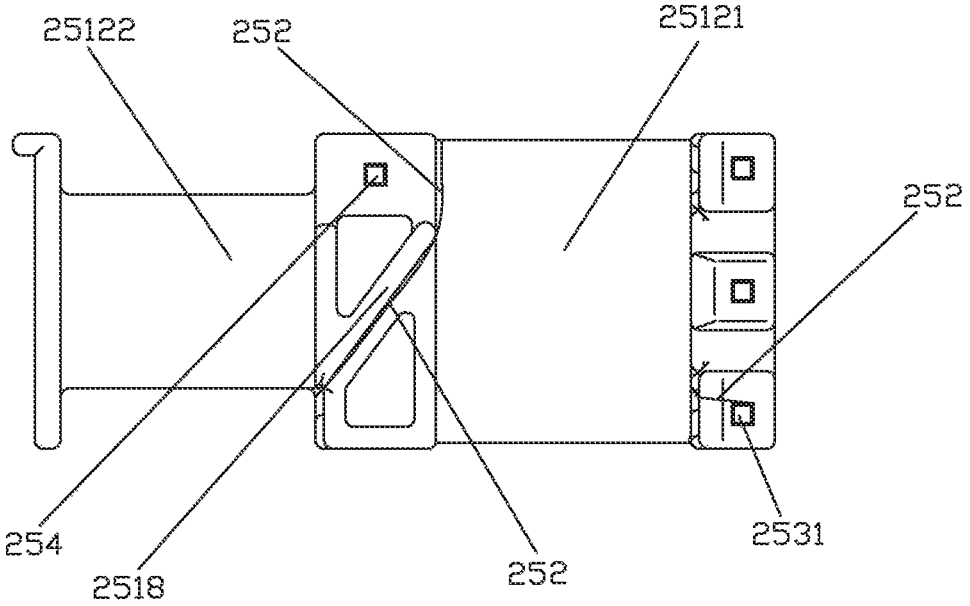
FIG. 21 is a schematic view of a process in which the coil structure of some embodiments of the present disclosure is wound by a single-coil method (the first process).
Figure 22:
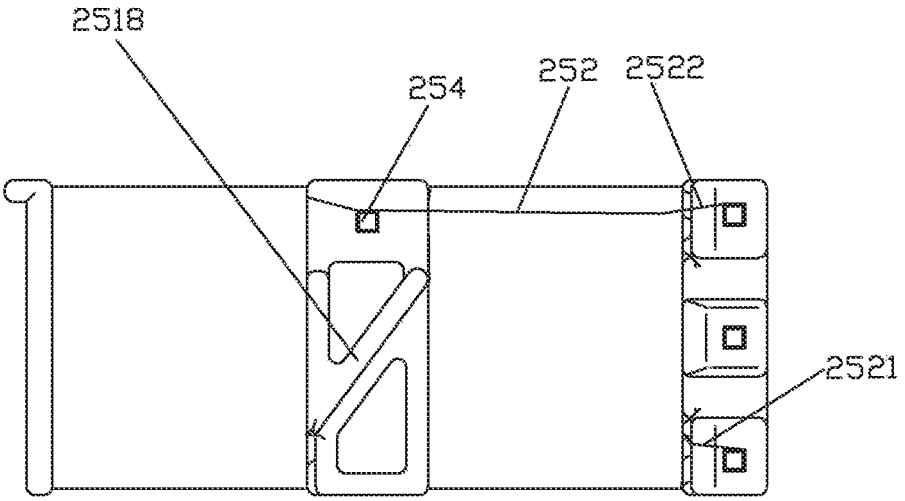
FIG. 22 is a schematic view of a process in which the coil structure of some embodiments of the present disclosure is wound by a single-coil method (the second process).
Figure 23:
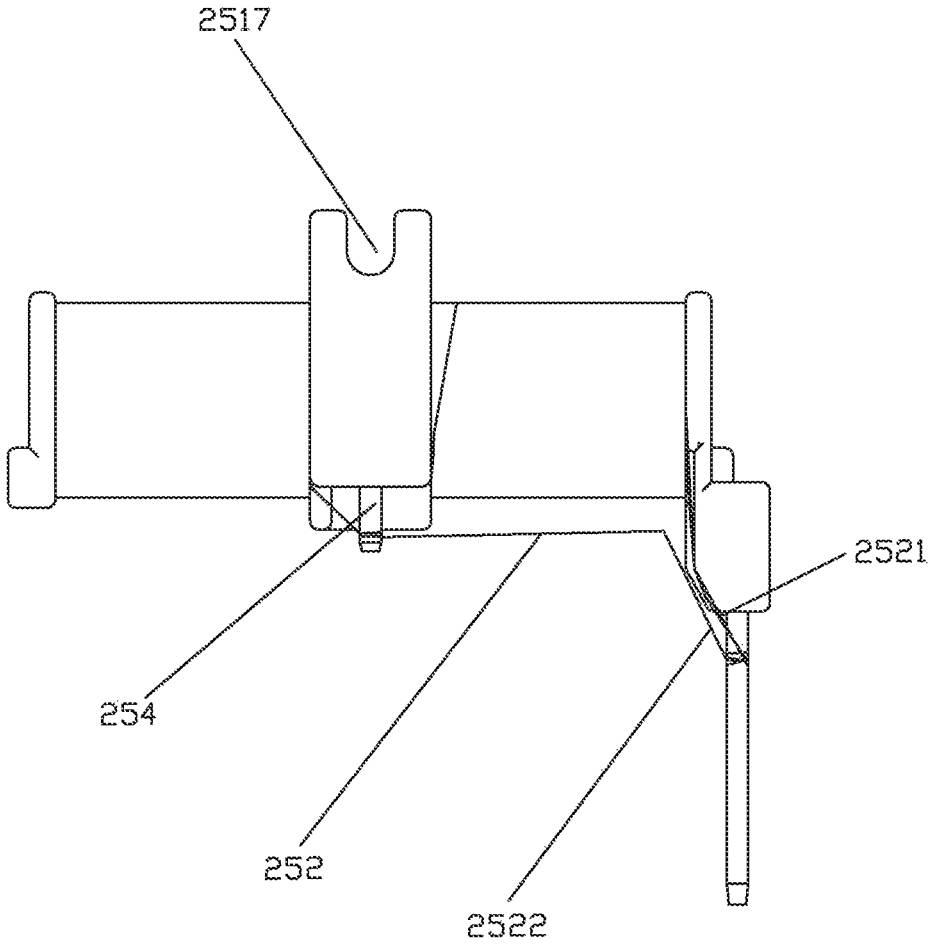
FIG. 23 is a schematic view of a process in which the coil structure of some embodiments of the present disclosure is wound by a single-coil method (the third process).

As shown in FIGS. 21 to 23, when use the single-coil method to wind the coil, drawing out the enameled wire 252 from the start terminal 2531, and then winding the first coil on the first winding window portion 25121, after winding the first coil, dragging the enameled wire 252 to the second winding window portion 25122 to wind the second coil, after winding the second coil, the enameled wire 252 is connected to the bridge terminal 254, and then is connected to the end terminal 2533 across the first winding window portion 25121 through the bridge terminal 254, so that the wound start wire 2521 and the end wire 2522 are spatially separated.

Figure 24:
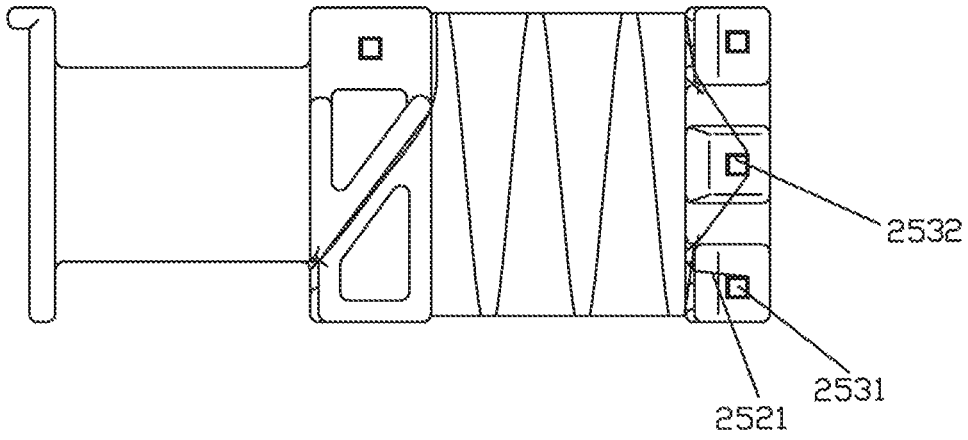
FIG. 24 is a schematic view of a process in which the coil structure of some embodiments of the present disclosure is wound by a double-coil method (the first process).
Figure 25:
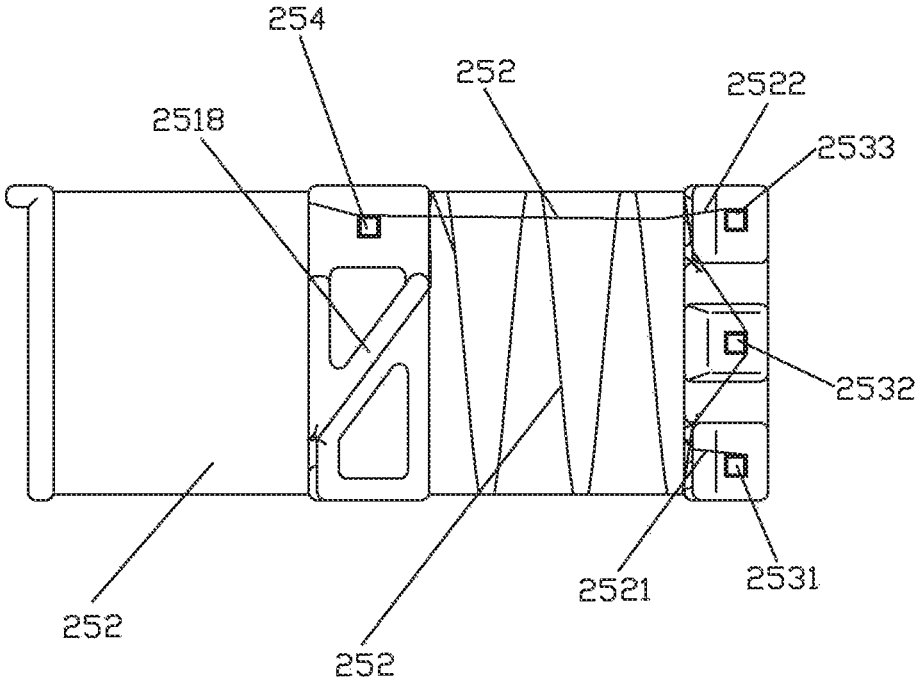
FIG. 25 is a schematic view of a process in which the coil structure of some embodiments of the present disclosure is wound by a double-coil method (the first process).

As shown in FIGS. 24 to 26, when use the double-coil method to wind the coil, drawing out the enameled wire 252 from the start terminal 2531, and then winding the first coil on the first winding window portion 25121, after winding the first coil, connecting the enameled wire 252 to the common end 2532, and then starting from the common terminal 2532, winding a few turns at a step with a large pitch on the first winding window portion 25121, and then dragging the enameled wire 252 to the second winding window portion 25121 through the wire groove 2518 to wind the second coil, after winding the second coil, the enameled wire 252 is connected to the bridge terminal 254, and then is connected to the end terminal 2533 across the first winding window portion 25121 through the bridge terminal 254, so that the start wire 2521 of the first coil of the double coil structure and the end wire 2522 of the second coil of the double coil structure are spatially separated.

Figure 16:
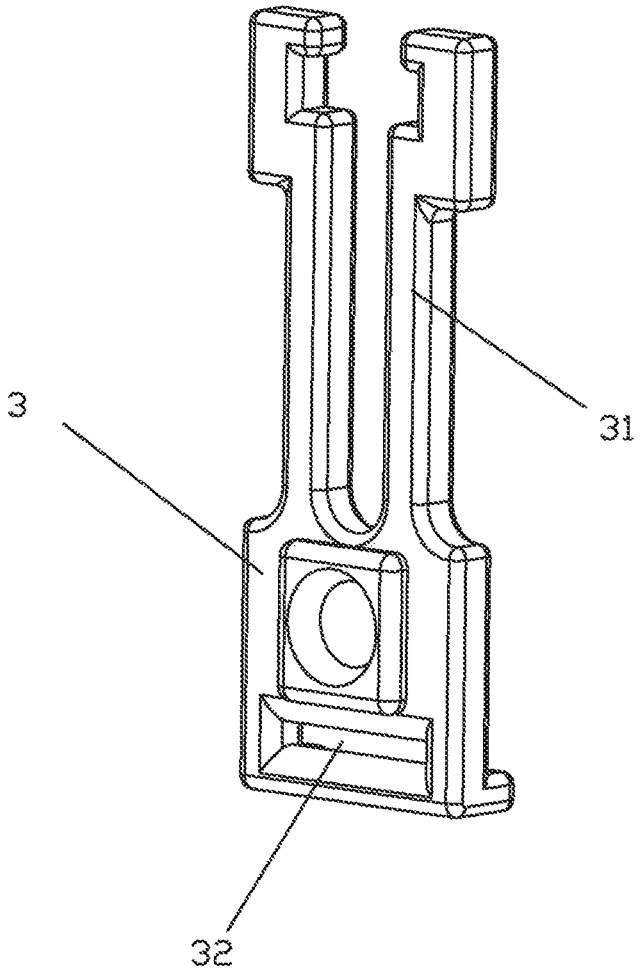
FIG. 16 is a perspective schematic view of the structure of pushing card of some embodiments of the present disclosure.
Figure 17:
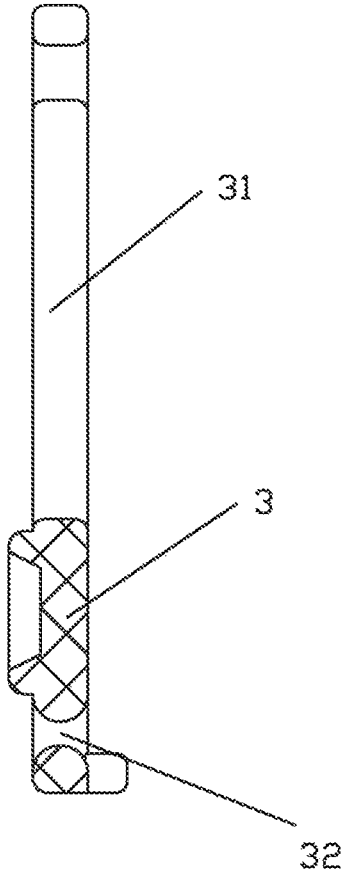
FIG. 17 is a cross-sectional view of the structure of the pushing card of some embodiments of the present disclosure.

In some embodiment, as shown in FIGS. 15 to 17, the pushing card 3 is provided with two connecting arms 31 with a certain distance therebetween and a certain length, the two connecting arms are formed by the upper portion of the pushing card 3 protruding upwards, so that the two connecting arms 31 can be flexibly expanded to make the two sides of the armature 24 in the width direction be snapped into the pushing card 3 (that is, snapped between the two connecting arms 31), and realize that when the armature 24 swings up and down, the pushing card 3 is driven to move up and down.

In some embodiments, the lower portion of the pushing card 3 is provided with a substantially rectangular through hole 32, and the end of the movable spring 41 provided with a movable contact is movably hooked in the through hole 32 of the lower portion of the pushing card 3, when the pushing card 3 moves up and down, the end of the movable spring 41 with the movable contact swings up and down (as shown in FIG. 15). The upper and lower hole walls of the through hole 32 of the pushing card 3 are respectively designed as a circular arc surface, so that when the pushing card 3 moves, the pushing card 3 and the movable spring 41 come into line-to-surface contact, the distance between the upper hole wall and the lower hole wall of the through hole 32 is greater than the thickness of the end of the movable spring 41 where the movable contact is provided. It should be noted that "substantially" in the present disclosure means approximately, for example, substantially rectangular means not strictly rectangular, it may be a rectangle with chamfers, or a square, which is not particularly limited.

A miniaturized high-power magnetic latching relay of some embodiments of the present disclosure adopts that a first blocking wall 11 is provided on the base 1 to divide the base 1 into an upper cavity 12 and a lower cavity 13, the magnetic circuit portion 2 and the contact portion 4 are respectively installed in the upper cavity 12 and the lower cavity 13 so as to achieve strong and weak electrical isolation. The present disclosure also adopts that the two yokes 22 are fixed to the two ends of the iron core 21, and the magnetic steel 23 is matched in the middle of the iron core 21, after the assembly of the iron core 21, the yokes 22, and the magnetic steel 23 is completed, the iron core 21, the yokes 22 and the magnetic steel 23 form an E-shaped magnetic conductive structure, that is, the shape of the magnetic conductive structure shown in FIG. 1 after being turned 90 degrees sideways. The middle position of the armature 24 is rotatably supported above the position corresponding to the magnetic steel 23, and the two ends of the armature 24 correspond to the two yokes 22 respectively, so as to perform the seesaw type movement in cooperation with the magnetic conductive structure, and the upper end of the pushing card 3 is connected to one end of the armature 24, and the lower end of the pushing card 3 is connected to the free end of the movable spring 41 of the contact portion 4. The structure of the present disclosure has the characteristics of simple parts structure but complete functions, small product size and large load capacity.

A miniaturized high-power magnetic latching relay of the present disclosure adopts that the upper cavity 12 of the base 1 is designed as a concave frame structure, and the lower cavity 13 is provided with openings communicating with the outside (that is, the left and right core pulling structure) along the width direction W of the base 1, which can realize that the mold structure is simple and the manufacturing cost is low.

In the miniaturized high-power magnetic latching relay of the present disclosure, two second blocking walls are provided at positions corresponding to the matching of the movable spring 41 and the stationary spring 42 in the lower cavity 13, so as to utilize the air gap between the two second blocking walls 131 and the two second blocking walls 131 to achieve the isolation between the movable spring 41 and the stationary spring 42 to effectively increase the insulation distance between the movable spring 41 and the stationary spring 42 and to prevent the insulation from falling between the movable spring 41 and the stationary spring 42 at the end of life due to contact splashes and the risk of fire.

The miniaturized high-power magnetic latching relay of the present disclosure adopts that the pushing card 3 is provided with two connecting arms 31 with a certain distance therebetween and a certain length, and the lower portion of the pushing card 3 is provided with a substantially rectangular through hole 32, the end of the movable spring 41 provided with a movable contact is movably hooked in the through hole 32 of the lower portion of the pushing card 3, and the upper and lower hole walls of the through hole 32 of the pushing card 3 are respectively designed as a circular arc surface, the distance between the upper wall and the lower wall of the through hole 32 is greater than the thickness of the end of the movable spring 41 where the movable contact is provided. In the structure of the present disclosure described above, the two connecting arms 31 can be flexibly expanded to make the two sides of the armature 24 in the width direction be snapped into the pushing card 3, and realize that when the armature 24 swings up and down, the pushing card 3 is driven to move up and down, and when the pushing card 3 moves, the pushing card 3 and the movable spring 41 come into line-to-surface contact, and a certain free stroke can be formed, so that when the relay opens the contacts, it has a certain acceleration process, which can better open the contacts, thereby improving the ability of the relay to resist surge current.

In summary, the magnetic latching relay of the present disclosure has the following beneficial effects:

1. The present adopts a first blocking wall 11 is provided on the base 1 to divide the base 1 into an upper cavity 12 and a lower cavity 13, the magnetic circuit portion 2 is installed in the upper cavity 12 and the contact portion 4 is installed in the lower cavity 13, so as to achieve strong and weak electrical isolation. The present disclosure also adopts the two yokes 22 are respectively fixed on both ends of the iron core 21, and the magnetic steel 23 is matched in the middle of the iron core 21, after the assembly of the iron core 21, the yoke 22 and the magnetic steel 23 is completed, the iron core 21, the yoke 22 and the magnetic steel 23 can form an E-shaped magnetic conductive structure, that is, the magnetic conductive structure shown in FIG. 1 after being turned 90 degrees sideways. The middle position of the armature 24 is rotatably supported above the position corresponding to the magnetic steel 23, so that the two ends of the armature 24 respectively correspond to the tops of the two yokes 22, so as to perform the seesaw type action in cooperation with the magnetic conductive structure; the upper end of the pushing card 3 is connected to one end of the armature 24, and the lower end of the pushing card 3 is connected to the free end of the movable spring 41 of the contact portion. The structure of the present disclosure has the characteristics of simple parts structure but complete functions, small product size and large load capacity.

2. The present disclosure adopts that the upper cavity 12 of the base 1 is designed as a concave frame structure, and the lower cavity 13 is provided with openings communicating with the outside (that is, the left and right core pulling structure) along the width direction W of the base 1, which can realize that the mold structure is simple and the manufacturing cost is low.

3. The present disclosure adopts that two second blocking walls are provided at positions corresponding to the matching of the movable spring 41 and the stationary spring 42 in the lower cavity 13, so as to utilize the air gap between the two second blocking walls 131 and the two second blocking walls 131 to achieve the isolation between the movable spring 41 and the stationary spring 42 to effectively increase the insulation distance between the movable spring 41 and the stationary spring 42 and to prevent the insulation from falling between the movable spring 41 and the stationary spring 42 at the end of life due to contact splashes and the risk of fire.

4. The present disclosure adopts that the pushing card 3 is provided with two connecting arms 31 with a certain distance therebetween and a certain length, and the lower portion of the pushing card 3 is provided with a substantially rectangular through hole 32, the end of the movable spring 41 provided with a movable contact is movably hooked in the through hole 32 of the lower portion of the pushing card 3, and the upper and lower hole walls of the through hole 32 of the pushing card 3 are respectively arranged in the shape of a circular arc surface, the distance between the upper hole wall and the lower hole wall of the through hole 32 is greater than the thickness of the end of the movable spring 41 where the movable contact is provided. In the structure of the present disclosure described above, the two connecting arms 31 can be flexibly expanded to make the two sides of the armature 24 in the width direction be snapped into the pushing card 3, and realize that when the armature 24 swings up and down, the pushing card 3 is driven to move up and down, and when the pushing card 3 moves, the pushing card 3 and the movable spring 41 come into line-to-surface contact, and a certain free stroke can be formed, so that when the relay opens the contacts, it has a certain acceleration process, which can better open the contacts, thereby improving the ability of the relay to resist surge current.

As described in the above embodiments, the coil structure generally includes a bobbin, an enameled wire, and coil terminals. The bobbin includes flanges at both ends and a winding window portion between the flanges at both ends. The enameled wire is wound in the winding window portion of the bobbin, because the coil terminals are located at one of the flanges of the bobbin, after the enameled wire is wound, its start wire and end wire need to be led to one of the flanges of the bobbin to connect with the coil terminal, which easily causes the start and end wires of the enameled wire to overlap together, especially, the coil structure in the magnetic latching relay also adopts the double coil structure, which is more likely to cause the start and end wires of the enameled wire to overlap together. When the coil structure is powered off, the reverse voltage easily breaks down the lap of the start wire and the end wire (when the start wire and end wire are lapped together, it is easy to form a voltage difference), causing the coil to short-circuit, resulting in the loss of relay function. In addition, for a coil structure provided with two winding windows portions, the start terminal, the common terminal and the end terminal are usually arranged on three flanges, in the case of a small product volume, the distance between the terminal of the coil and the movable and stationary springs is too short to meet the requirements of reinforced insulation. At the same time, when the user applies the relay, the distance between the strong and weak electricity is short, which is not conducive to the isolation of the strong and weak electricity, and it is easy to cause breakdown between the strong and weak electricity and cause the risk of short circuit, and if the user needs to install multiple products closely, considering the isolation of strong and weak electricity, the PCB board size will become very large.

In order to overcome the above-mentioned defects, referring to FIG. 1 to FIG. 26, this embodiment provides a coil structure including a bobbin 251, an enameled wire 252 and a coil terminal 253. The bobbin 251 includes flanges 2511 provided at both ends thereof along the longitudinal direction L (the longitudinal direction of the bobbin 251 is the same as the longitudinal direction of the base 1), and a winding window portion 2512 between the flanges 2511 at both ends, and an iron core mounting hole 2513 penetrating the flanges 2511 at both ends along the length direction L. The iron core 21 is installed inside the winding window portion 2512, and both ends of the iron core 21 are installed in the iron core mounting hole 2513 of the bobbin 251, both ends of the iron core 21 are fixed to the two yokes 22 by riveting outside the iron core mounting hole 2513, both ends of the iron core 21 are fixed to the yoke 22 by riveting outside the iron core mounting hole 2513. In the middle of the winding window portion 2512 of the bobbin 251, a retaining wall 2514 is further provided to divide the winding window portion 2512 of the bobbin 251 into isolated first winding window portion 25121 and a second winding window portion 25122; the coil terminal 253 includes a start terminal 2531, a common terminal 2532, and an end terminal 2533, the three terminals are installed side by side along the width direction W of the bobbin 251 in the flange 2511 on the side close to the first winding window portion 25121, and the three coil terminals 253 have the same orientation. As shown in FIG. 13, a wire groove 2518 for connecting the first winding window portion 25121 and the second winding window portion 25122 is provided on the retaining wall 2514, and a bridge terminal 254 (as shown in FIG. 26) is installed in the retaining wall 2514, and the orientation of the bridge terminal 254 is the same as the orientation of the three terminals. The enameled wire 252 starts from the start terminal 2531 and is wound by a single-coil method or a double-coil method, and then is connected to a bridge terminal 254, and is connected to the end terminal 2533 across the first winding window portion 25121 through the bridge terminal 254, so that the wound start wire 2521 and the end wire 2522 are spatially separated.

In some embodiments, as shown in FIG. 13, three terminal holes 2611 for inserting the three terminals are provided in the flange 2511 on the side close to the first winding window portion 25121, the three terminal holes 2611 are arranged at regular intervals along the width direction W of the bobbin 251. The three terminals such as the start terminal 2531, the common terminal 2532, and the end terminal 2533 are inserted into the corresponding terminal holes 2611, respectively, the common terminal 2532 is inserted into the terminal hole 2611 in the middle position among the three terminal holes 2611.

Figure 11:
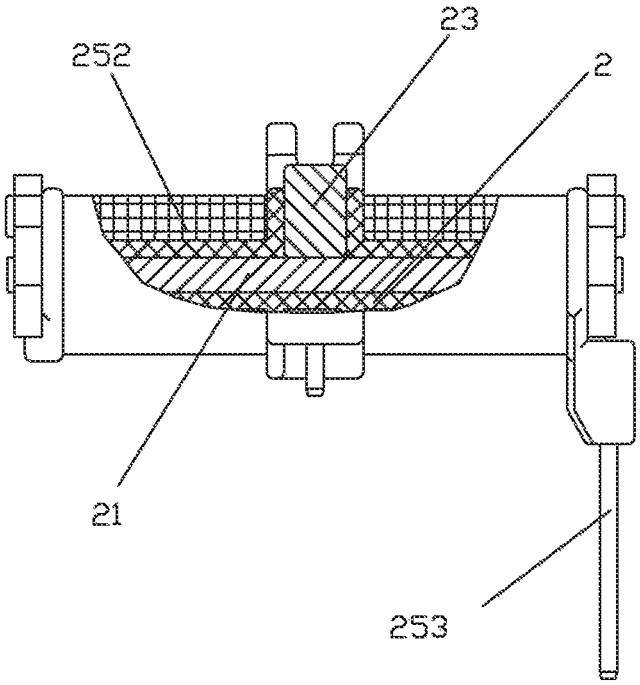
FIG. 11 is a cross-sectional view of the bobbin of some embodiments of the present disclosure installed with the magnetic steel.

In some embodiments, the cross-sectional shape of the winding window portion 2512 is substantially rectangular, and the retaining wall 2514 is substantially rectangular shape. The wire groove 2518 and the bridge terminal 254 are respectively provided on the bottom surface of the retaining wall 2514. As shown in FIG. 11, a first slot 25141 is provided at the connection position corresponding to the bridge terminal 254, the bridge terminal 254 is inserted into the first slot 25141 of the retaining wall 2514, and both of them are in an interference fit.

In some embodiments, the wire groove 2518 is diagonally connected between the first winding window portion 25121 and the second winding window portion 25122.

In some embodiments, in the groove walls on both sides of the wire groove 2518, the positions connected to the first winding window portion 25121 and the second winding window portion 25122 are respectively set in an arc-shaped structure to avoid scratching the enameled wire.

In some embodiments, the top surface of the retaining wall 2514 is provided with a recess 2515 that is recessed downwards and used to install magnetic steel. The recess 2515 communicates with the iron core mounting hole 2513.

In some embodiments, as shown in FIG. 12, limiting lug bosses 2516 are provided on both sides of the recess 2515 to restrict the movement of the magnetic steel 23 inserted into the recess 2515 along the width direction W of the bobbin 251 (the width direction of the bobbin 251 is the same as the width direction of the base), in one embodiment, there are two limiting lug bosses 2516.

In some embodiments, as shown in FIG. 8, the top of the limiting lug boss 2516 is provided with a semi-circular notch 2517 for installing the shaft 261 of the armature 24 to match the shaft 261 of the shaft component 26 of the armature 24 to restrict the movement of the shaft 261 of the armature 24 along the length direction L of the bobbin 251.

In the present disclosure, the relay may adopt the single-coil method to wind the coil or the double-coil method to wind the coil.

When use the single-coil method to wind the coil, as shown in FIGS. 21 to 23, drawing out the enameled wire 252 from the start terminal 2531, and then winding the first coil on the first winding window portion 25121, after winding the first coil, dragging the enameled wire 252 to the second winding window portion 25122 through the wire groove 2518 to wind the second coil, after winding the second coil, the enameled wire 252 is connected to the bridge terminal 254, and then is connected to the end terminal 2533 across the first winding window portion 25121 through the bridge terminal 254, so that the wound start wire 2521 and the end wire 2522 are spatially separated.

When use the double-coil method to wind the coil, as shown in FIGS. 24 to 26, drawing out the enameled wire 252 from the start terminal 2531, and then winding the first coil on the first winding window portion 25121, after winding the first coil, connecting the enameled wire 252 to the common terminal 2532, and then starting from the common terminal 2532, winding a few turns at a step with a large pitch on the first winding window portion 25121, and then dragging the enameled wire 252 to the second winding window portion 25122 through the wire groove 2518 to wind the second coil, after winding the second coil, the enameled wire 252 is connected to the bridge terminal 254, and then is connected to the end terminal 2533 across the first winding window portion 25121 through the bridge terminal 254, so that the start wire 2521 of the first coil of the double coil structure and the end wire 2522 of the second coil of the double coil structure are spatially separated.

In the coil structure and the magnetic latching relay according to the embodiments of the present disclosure, a retaining wall 2514 is further provided in the middle of the winding window portion 2512 of the bobbin 251 to divide the winding window portion 2512 of the bobbin 251 into an isolated first winding window portion 25121 and a second winding window portion 25122; the coil terminal 253 includes a start terminal 2531, a common terminal 2532, and an end terminal 2533, the three terminals are installed side by side along the width direction W of the bobbin 251 in the flange 2511 on the side close to the first winding window portion 25121, and the three terminals have the same orientation. A wire groove 2518 for connecting the first winding window portion 25121 and the second winding window portion 25122 is provided on the retaining wall 2514, and a bridge terminal 254 is installed in the retaining wall 2514, and the orientation of the bridge terminal 254 is the same as the orientation of the three coil terminals 253. The enameled wire 252 starts from the start terminal 2531 and is wound by a single-coil method or a double-coil method, and then is connected to a bridge terminal 254, and is connected to the end terminal 2533 across the first winding window portion 25121 through the bridge terminal 254, so that the wound start wire 2521 and the end wire 2522 are spatially separated. The structure of the present disclosure can effectively avoid the shortcomings of the coil short circuit caused by the overlapping of the start and end wires of the enameled wire 252, and can also meet the strong and weak electrical isolation requirements when the product is applied to a large current occasion.

In the coil structure and the magnetic holding relay of the embodiment of the present disclosure, because three terminals are installed side by side in the width direction W of the bobbin 251 in the flange 2511 on the side of the first winding window portion 25121, the coil terminal 253 has a large distance from the movable spring 41 and the stationary spring 42, which not only can achieve the function of strengthening insulation in a small volume, but also can meet the user's strong and weak electrical isolation requirements for tight installation of multiple products without increasing the PCB area.

Because the disclosure adopts that a retaining wall 2514 is provided in the middle of the winding window portion 2512 of the bobbin 251 to divide the winding window portion 2512 of the bobbin 251 into an isolated first winding window portion 25121 and a second winding window portion 25122, the coil structure 25 further includes an enameled wire 252 and a coil terminal 253; the coil terminal 253 includes a start terminal 2531, a common terminal 2532, and an end terminal 2533, the three terminals are installed side by side along the width direction W of the bobbin 251 in the flange 2511 on the side close to the first winding window portion 25121, and the three coil terminal 253 has the same orientation, a wire groove 2518 for connecting the first winding window portion 25121 and the second winding window portion 25122 is provided on the retaining wall 2514, and a bridge terminal 254 is installed in the retaining wall 2514, and the orientation of the bridge terminal 254 is the same as the orientation of the three terminal; The enameled wire 252 starts from the start terminal 2531 and is wound by a single coil method or a double coil method, and then is connected to a bridge terminal 254, and is connected to the end terminal 2533 across the first winding window portion 25121 through the bridge terminal 254, so that the wound start wire 2521 and the end wire 2522 are spatially separated. The structure of the present disclosure can effectively avoid the shortcomings of the coil short circuit caused by the overlapping of the start and end wires of the enameled wire 252, and can also meet the strong and weak electrical isolation requirements when the product is applied to a large current occasion.

The above is only a preferred embodiment of the present disclosure, and does not limit the present disclosure in any form. Although the present disclosure has been disclosed as above with preferred embodiments, it is not intended to limit the present disclosure. Any person skilled in the art, without departing from the scope of the technical solutions of the present disclosure, can use the technical content disclosed above to make many possible changes and modifications to the technical solutions of the present disclosure, or to modify into equivalent embodiments. Therefore, any simple modifications, equivalent changes, and modifications to the above embodiments based on the technical essence of the present disclosure without departing from the technical solutions of the present disclosure shall fall within the protection scope of the technical solutions of the present disclosure.

What is claimed is:

1. A magnetic latching relay, comprising:

a base, a magnetic circuit portion, a pushing card, a contact portion;

the base is provided with a first blocking wall to divide the base into an upper cavity and a lower cavity, the magnetic circuit portion is installed in the upper cavity and the contact portion is installed in the lower cavity; wherein the lower cavity is provided with openings communicating with an outside along a width direction of the base, a movable spring and a stationary spring in the contact portion are respectively inserted into the lower cavity from two openings along the width direction of the base and are fixed by being inserted and connected through horizontal slots provided in the lower cavity;

the magnetic circuit portion comprising an iron core, two yokes, a magnetic steel and an armature;

the iron core is strip-shaped and arranged horizontally, and the two yokes are plate-shaped, wherein the two yokes are respectively fixed on both ends of the iron core, and the magnetic steel is matched in the middle of the iron core, so that the iron core, the two yokes and the magnetic steel are arranged to form an E-shaped magnetic conductive structure;

the middle position of the armature is rotatably supported above the position corresponding to the magnetic steel, and each end of the armature is located above a top surface of respective one of the two yokes, so as to perform the seesaw type action in cooperation with the magnetic conductive structure;

an upper end of the pushing card is connected to one end of the armature, and a lower end of the pushing card is connected to a free end of the movable spring of the contact portion.

2. The magnetic latching relay according to claim 1, wherein the iron core is a flat strip-shaped structure, a square through hole is provided at the center of each of the two yokes, the two yokes are riveted and fixed to the two ends of the iron core along the longitudinal direction through the square through hole;

two positioning protrusions are provided on both sides of each of the two yokes, the positioning protrusions are configured as a positioning structure of the magnetic circuit portion cooperating with the base;

the top of each of the two yokes is arranged as a working pole surface matched with both ends of the armature.

3. The magnetic latching relay according to claim 1, wherein the iron core is arranged to extend along the length direction of the base, in the longitudinal direction of the base, an receiving groove of which an opening is configured to face the front and outside is provided on a front end of the base and the receiving groove is used to accommodate the pushing card, one end of the armature is configured to extend from above of the upper cavity to above of the receiving groove and connect to the upper end of the pushing card accommodated in the receiving groove;

the bottom of the receiving groove is configured to communicate with the lower cavity so that the lower end of the pushing card accommodated in the receiving groove is connected to a free end of the movable spring of the contact portion in the lower cavity.

4. The magnetic latching relay according to claim 3, wherein the upper cavity is a frame structure with a concave shape, and a front portion of the upper cavity is arranged as a support platform for supporting the front of the magnetic circuit portion, a rear portion of the upper cavity is arranged as a slot for matching the coil structure of the magnetic circuit portion, and a ramp-shaped web is formed between the front portion and the rear portion.

5. A magnetic latching relay comprising:

a base, a magnetic circuit portion, a pushing card, a contact portion;

the base is provided with a first blocking wall to divide the base into an upper cavity and a lower cavity, the magnetic circuit portion is installed in the upper cavity and the contact portion is installed in the lower cavity;

the magnetic circuit portion comprising an iron core, two yokes, a magnetic steel, and an armature;

the iron core is strip-shaped and arranged horizontally, and the two yokes are plate-shaped, wherein the two yokes are respectively fixed on both ends of the iron core, and the magnetic steel is matched in the middle of the iron core, so that the iron core, the two yokes and the magnetic steel are arranged to form an E-shaped magnetic conductive structure;

the middle position of the armature is rotatably supported above the position corresponding to the magnetic steel, and each end of the armature is located above a top surface of respective one of the two yokes, so as to perform the seesaw type action in cooperation with the magnetic conductive structure;

an upper end of the pushing card is connected to one end of the armature, and a lower end of the pushing card is connected to a free end of a movable spring of the contact portion;

the iron core is arranged to extend along the length direction of the base, in the longitudinal direction of the base, a receiving groove of which an opening is configured to face the front and outside is provided on a front end of the base and the receiving groove is used to accommodate the pushing card, one end of the armature is configured to extend from above of the upper cavity to above of the receiving groove and connect to the upper end of the pushing card accommodated in the receiving groove;

the bottom of the receiving groove is configured to communicate with the lower cavity so that the lower end of the pushing card accommodated in the receiving groove is connected to a free end of the movable spring of the contact portion in the lower cavity;

wherein both sides of a front end and a rear end of the upper cavity are respectively provided with notches for assembling the magnetic circuit portion to achieve positioning;

dispensing gates are respectively provided on both sides of the receiving groove to fix the magnetic circuit portion when the magnetic circuit portion is inserted into the upper cavity and the clamping force is insufficient.

6. The magnetic latching relay according to claim 1, wherein there are two second blocking walls at positions corresponding to the matching of the movable spring and the stationary spring to realize an isolation between the movable spring and the stationary spring by using the two second blocking walls and an air gap between the two second blocking walls.

7. The magnetic latching relay according to claim 4, wherein the coil structure comprises a bobbin;

the bobbin comprises flanges at both ends along the length direction, a winding window portion between the flanges at both ends, and an iron core mounting hole penetrating through the flanges at both ends along the length direction;

wherein the winding window portion is rod-shaped and hollow;

a retaining wall is also provided in the middle of the winding window portion of the bobbin to divide the winding window portion of the bobbin into isolated first winding window portion and a second winding window portion;

a top surface of the retaining wall is provided with a recess recessed downward, and the recess is configured to communicate with the iron core mounting hole;

the iron core is installed inside the winding window portion, and both ends of the iron core are installed in the iron core mounting hole, the two yokes are respectively fitted at outside of the flanges at both ends of the bobbin, and the magnetic steel is installed in the recess;

limiting lug bosses are provided on both sides of the recess to restrict a movement of the magnetic steel inserted into the recess along a width direction of the bobbin.

8. The magnetic latching relay according to claim 7, wherein a shaft component is also installed in the middle of the armature so that both ends of the armature have a seesaw structure;

shafts are provided on both sides of the shaft component respectively, the top of each of the limiting lug bosses is provided with a semi-circular notch for installing the shaft of the armature to match the shaft of the shaft component of the armature to restrict the movement of the shaft of the armature along a length direction of the bobbin.

9. The magnetic latching relay according to claim 8, wherein giving way notches are provided on both sides distributed along the width direction of the armature, the giving way notches are configured to extend from a position of the armature near one end to a position of the armature near the middle, so as to facilitate installation of the shaft component, the shaft component is inserted into the armature through the giving way notches and is moved to the middle to form an interference fit with the armature, two limiting protrusions are provided on both sides of the middle portion of the armature near the other end of the armature in the width direction to limit the movement of the shaft component in a direction of toward one end of the armature.

10. The magnetic latching relay according to claim 7, wherein the coil structure further comprises an enameled wire and a coil terminal;

the coil terminal comprises a start terminal, a common terminal and an end terminal, the three terminals are installed side by side along the width direction of the bobbin in a flange on a side close to the first winding window portion, and the three terminals have the same orientation;

a wire groove for connecting the first winding window portion and the second winding window portion is provided on the retaining wall, and a bridge terminal is installed in the retaining wall, and orientation of the bridge terminal is the same as the orientation of the three terminals;

the enameled wire is configured to start from the start terminal and connect to the bridge terminal after being wound by a single-coil method or a double-coil method, and is connected to the end terminal across the first winding window portion through the bridge terminal, so that a start wire and an end wire after wound are spatially separated.

11. The magnetic latching relay according to claim 10, wherein three terminal holes for inserting the three terminals are provided in the flange on a side close to the first winding window portion, the three terminal holes are arranged at regular intervals along the width direction of the bobbin, the common terminal is inserted into a terminal hole which is located in a middle position among the three terminal holes.

12. The magnetic latching relay according to claim 11, wherein the single-coil method is that drawing out the enameled wire from the start terminal, and then winding a first coil on the first winding window portion, after winding the first coil, dragging the enameled wire to the second winding window portion through the wire groove to wind a second coil, after winding a second coil, the enameled wire is connected to the bridge terminal, and then is connected to the end terminal across the first winding window portion through the bridge terminal, so that the start wire and the end wire after wound are spatially separated.

13. The magnetic latching relay according to claim 11, wherein the double-coil method is that drawing out the enameled wire from the start terminal, and then winding a first coil on the first winding window portion, after winding the first coil, connecting the enameled wire to the common terminal, and then starting from the common terminal, winding a few turns at a step with a large pitch on the first winding window portion, and then dragging the enameled wire to the second winding window portion through the wire groove to wind a second coil, after winding the second coil, the enameled wire is connected to the bridge terminal, and then is connected to the end terminal across the first winding window portion through the bridge terminal, so that the start wire of the first coil of the double coil structure and the end wire of the second coil of the double coil structure are spatially separated.

14. The magnetic latching relay according to claim 10, wherein a cross-sectional shape of the winding window portion is substantially rectangular, and the retaining wall is substantially rectangular shape, the wire groove and the bridge terminal are respectively provided on a bottom surface of the retaining wall, a first slot is provided at a connection position corresponding to the bridge terminal, the bridge terminal is inserted into the first slot of the retaining wall, and both of the bridge terminal and the first slot are in an interference fit.

15. The magnetic latching relay according to claim 14, wherein the wire groove is diagonally connected between the first winding window portion and the second winding window portion.

16. The magnetic latching relay according to claim 10, wherein in groove walls on both sides of the wire groove, positions connected to the first winding window portion and the second winding window portion are respectively set in an arc-shaped structure.

17. The magnetic latching relay according to claim 11, wherein a cross-sectional shape of the winding window portion is substantially rectangular, and the retaining wall is substantially rectangular shape, the wire groove and the bridge terminal are respectively provided on a bottom surface of the retaining wall, a first slot is provided at a connection position corresponding to the bridge terminal, the bridge terminal is inserted into the first slot of the retaining wall, and both of the bridge terminal and the first slot are in an interference fit.

18. The magnetic latching relay according to claim 1, wherein the pushing card is provided with two connecting arms with a certain distance therebetween and a certain length, the two connecting arms are formed by an upper portion of the pushing card protruding upwards, so that the two connecting arms can be flexibly expanded to make two sides of the armature in the width direction be snapped between the two connecting arms, and realizing that when the armature swings up and down, the pushing card is driven to move up and down.

19. A magnetic latching relay comprising:

a base, a magnetic circuit portion, a pushing card, a contact portion;

the base is provided with a first blocking wall to divide the base into an upper cavity and a lower cavity, the magnetic circuit portion is installed in the upper cavity and the contact portion is installed in the lower cavity;

the magnetic circuit portion comprising an iron core, two yokes, a magnetic steel, and an armature;

the iron core is strip-shaped and arranged horizontally, and the two yokes are plate-shaped, wherein the two yokes are respectively fixed on both ends of the iron core, and the magnetic steel is matched in the middle of the iron core, so that the iron core, the two yokes and the magnetic steel are arranged to form an E-shaped magnetic conductive structure;

the middle position of the armature is rotatably supported above the position corresponding to the magnetic steel, and each end of the armature is located above a top surface of respective one of the two yokes, so as to perform the seesaw type action in cooperation with the magnetic conductive structure;

an upper end of the pushing card is connected to one end of the armature, and a lower end of the pushing card is connected to a free end of a movable spring of the contact portion;

the pushing card is provided with two connecting arms with a certain distance therebetween and a certain length, the two connecting arms are formed by an upper portion of the pushing card protruding upwards, so that the two connecting arms can be flexibly expanded to make two sides of the armature in the width direction be snapped between the two connecting arms, and realizing that when the armature swings up and down, the pushing card is driven to move up and down;

wherein a lower portion of the pushing card is provided with a substantially rectangular through hole, and an end of the movable spring provided with a movable contact is movably hooked in the through hole of the lower portion of the pushing card, when the pushing card moves up and down, the end of the movable spring with the movable contact swings up and down;

an upper hole wall and a lower hole wall of the through hole of the pushing card are respectively arranged in a shape of a circular arc surface, so that when the pushing card moves, the pushing card and the movable spring come into line-to-surface contact, a distance between the upper hole wall and the lower hole wall of the through hole is greater than a thickness of the end of the movable spring where the movable contact is provided.

* * * * *